US006218925B1

(12) United States Patent
Iwao

(10) Patent No.: US 6,218,925 B1
(45) Date of Patent: Apr. 17, 2001

(54) ELECTRONIC COMPONENTS

(75) Inventor: Hidemi Iwao, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/227,188

(22) Filed: Jan. 8, 1999

(30) Foreign Application Priority Data

Jan. 8, 1998 (JP) ..... 10-002472

(51) Int. Cl.[7] ..... H01F 5/00
(52) U.S. Cl. ..... 336/200; 336/83; 336/232
(58) Field of Search ..... 336/200, 232, 336/83, 192, 221; 29/602.1

(56) References Cited

U.S. PATENT DOCUMENTS 3,765,082 * 10/1973 Zyetz ..... 336/200
3,812,442 5/1974 Muckelroy .
4,543,553 * 9/1985 Mandai et al. ..... 336/83
5,032,815 * 7/1991 Kobayashi et al. ..... 336/83
5,302,932 * 4/1994 Person et al. ..... 336/200
5,821,846 * 10/1998 Leigh et al. ..... 336/200
5,945,902 * 8/1999 Lipkes et al. ..... 336/200

FOREIGN PATENT DOCUMENTS

H8-55726 2/1996 (JP) .

* cited by examiner

*Primary Examiner*—Michael L. Gellner
*Assistant Examiner*—Tuyen T. Nguyen
(74) *Attorney, Agent, or Firm*—Lowe Hauptman Gilman & Berner, LLP

(57) ABSTRACT

An electronic component is provided wherein the winding center line (Y) of a coil 72 buried in a rectangular-parallelepiped-shaped chip 71 is set on a straight line joining the central points of a pair of square opposed end surfaces of the chip where terminal electrodes 73*a* and 73*b* are formed, wherein the coil 72 is arranged so that the winding locus of the coil 72 as seen in the direction of the winding center line is located line-symmetrically around each of any two crossing straight lines crossing the winding center line (Y) of the coil 72 perpendicularly, and wherein leadout conductors 74*a* and 74*b* each joining the end of the coil and the terminal electrode 73*a* and 73*b* are located at the respective ends of the chip on the winding center line of the coil 72. Thus, this electronic component includes the coil that prevents the inductance from being changed by the mounting orientation.

50 Claims, 29 Drawing Sheets

*Fig.* 1
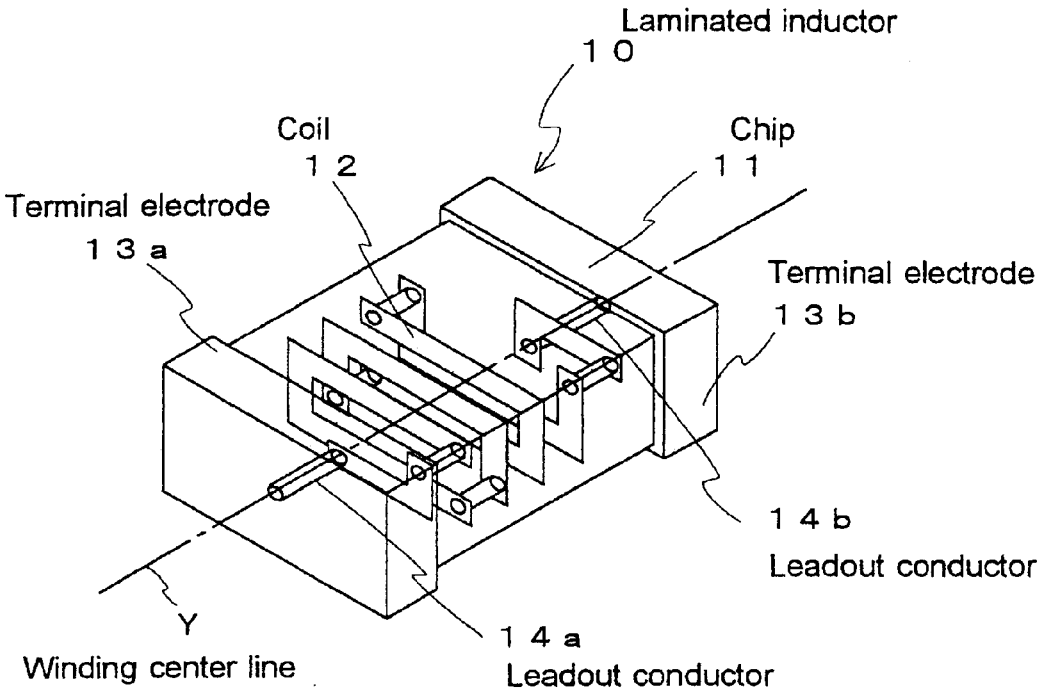
*Fig.* 2 Prior Art
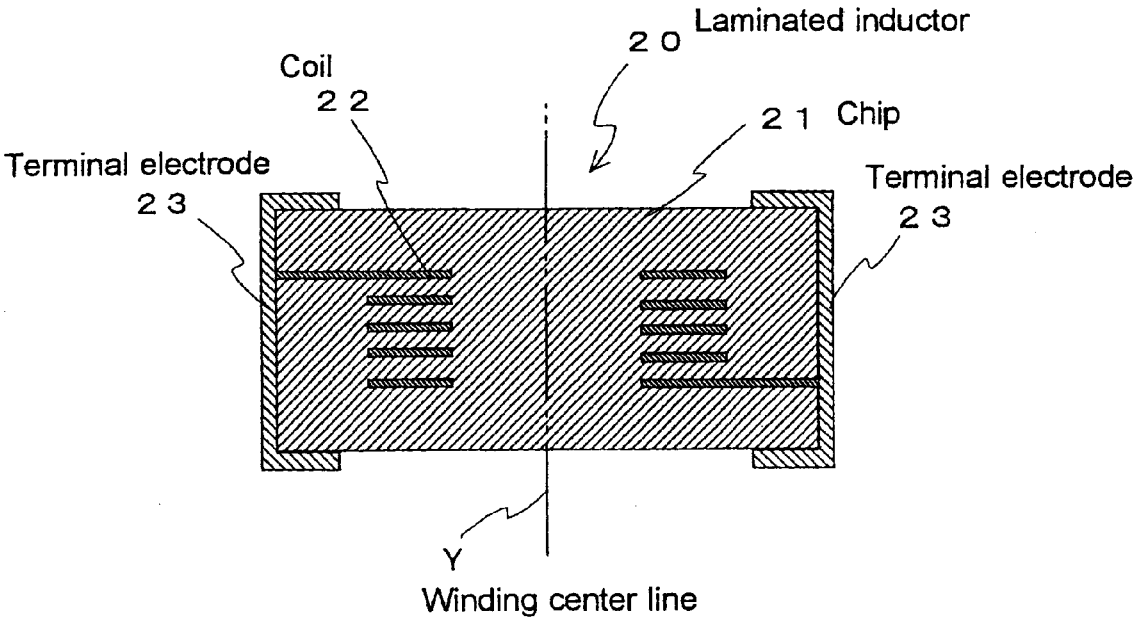

*Fig.* 3 Prior Art
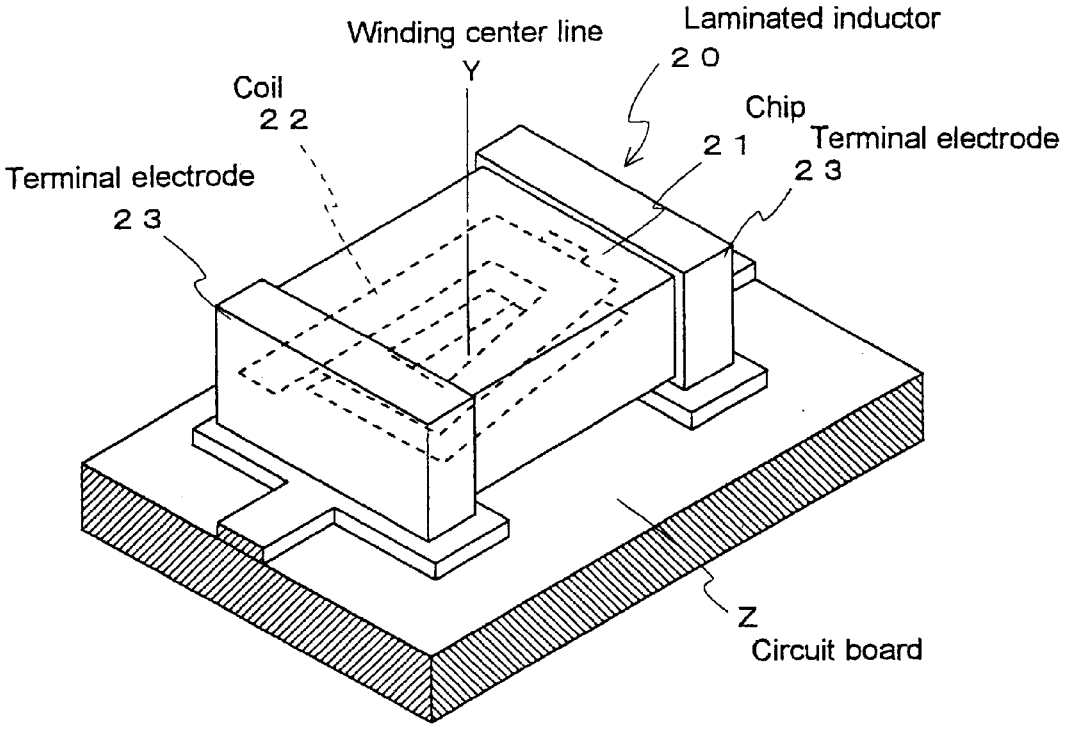
*Fig.* 4 Prior Art
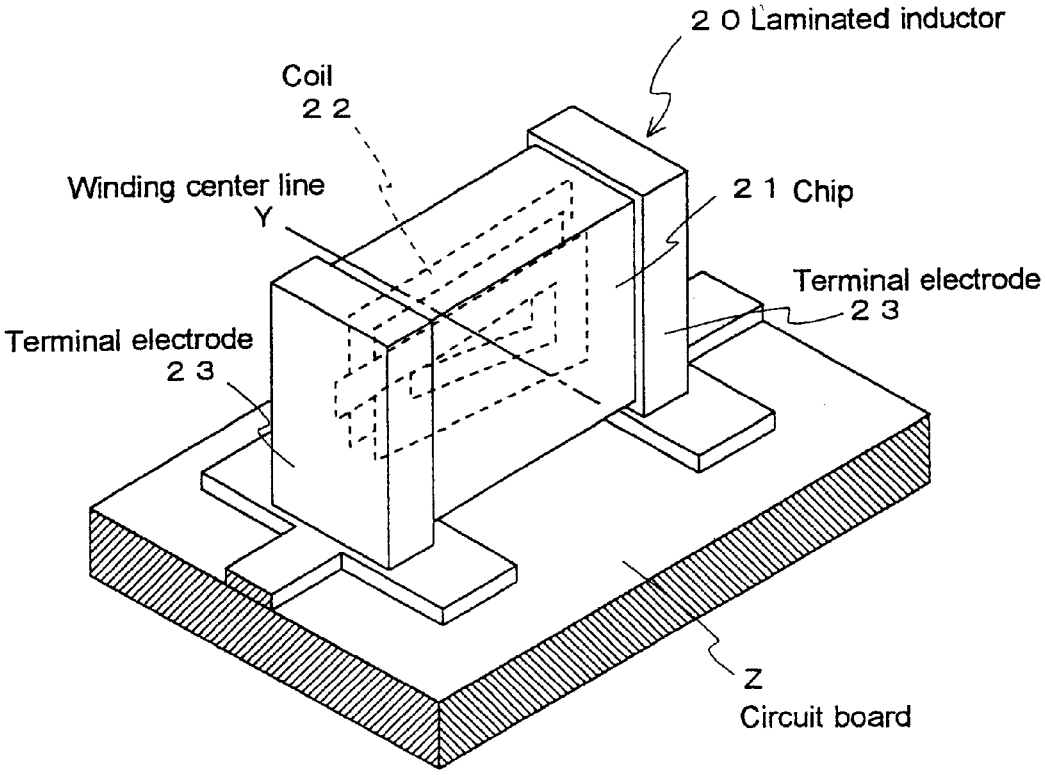

*Fig.* 5 Prior Art
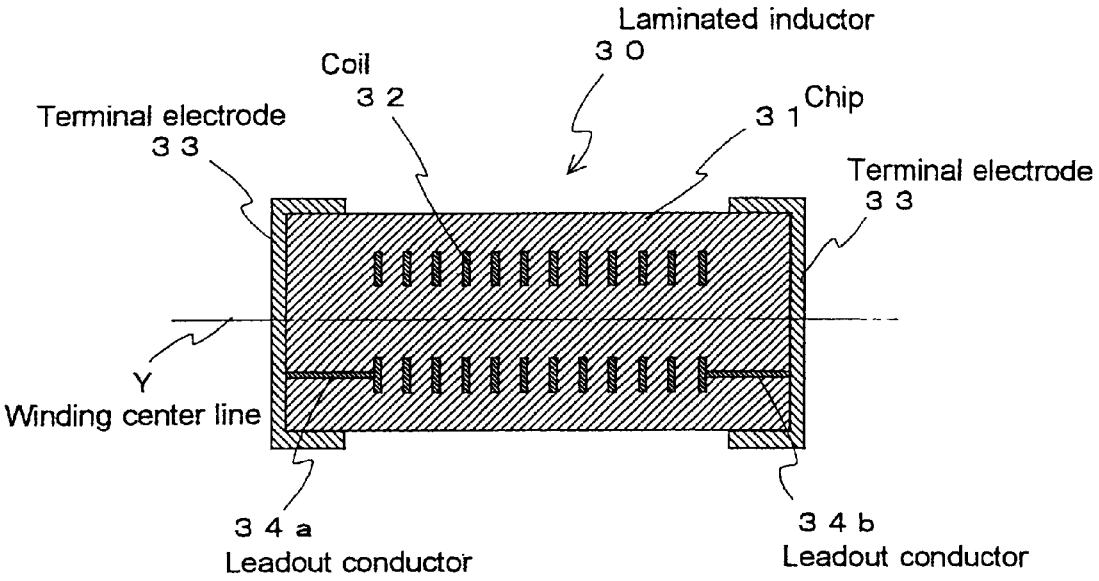
*Fig.* 6 Prior Art
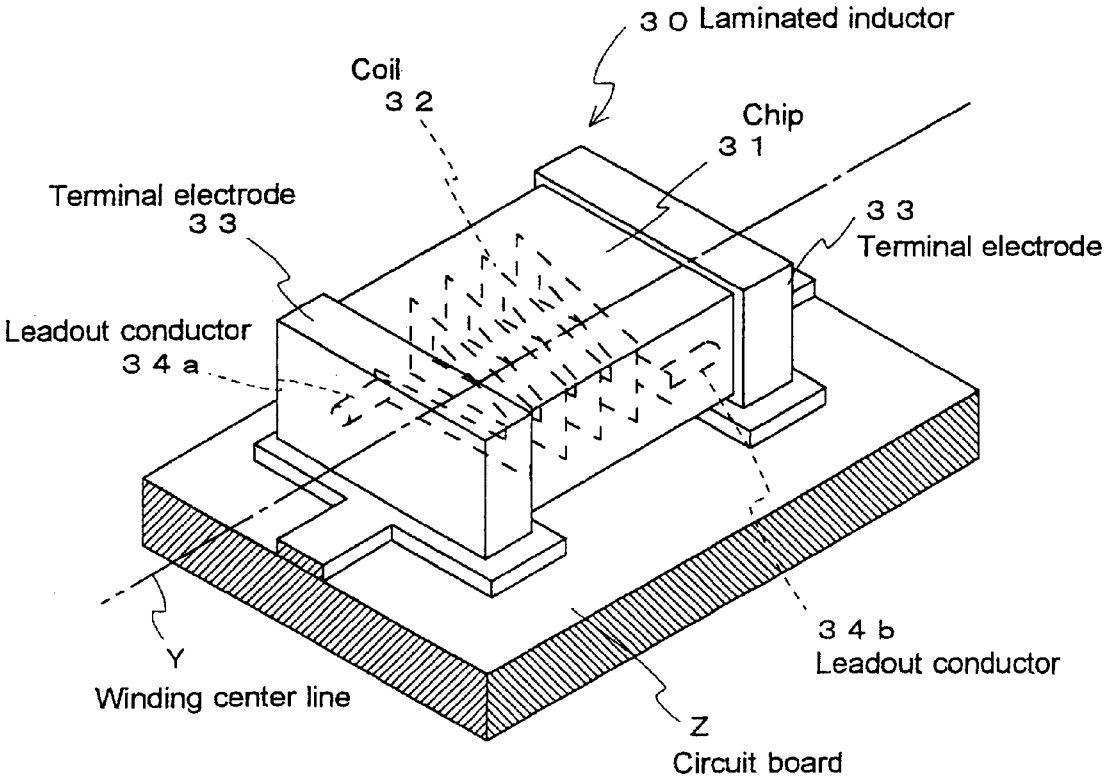

*Fig.* 7 Prior Art
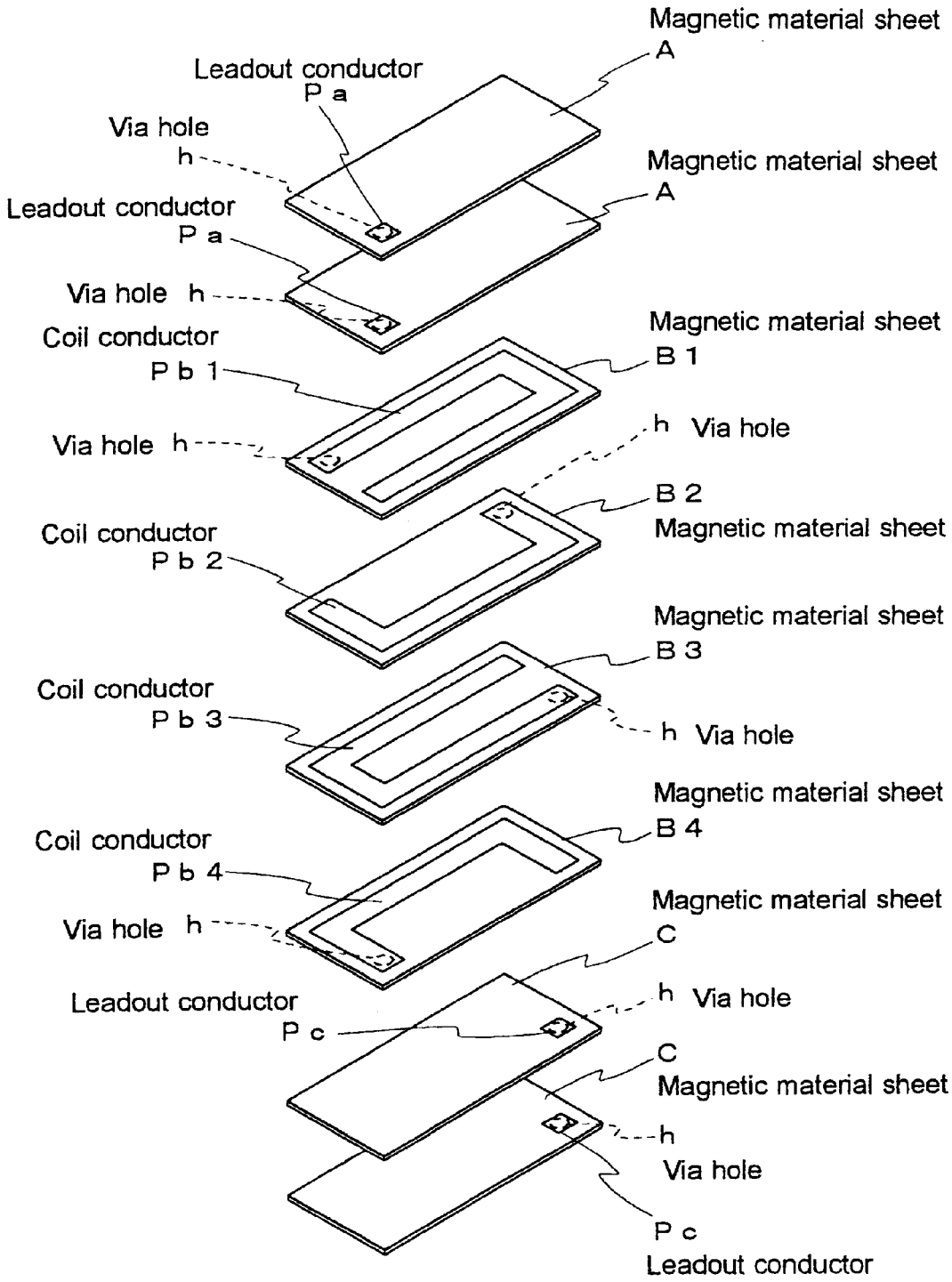

*Fig.* 8 Prior Art
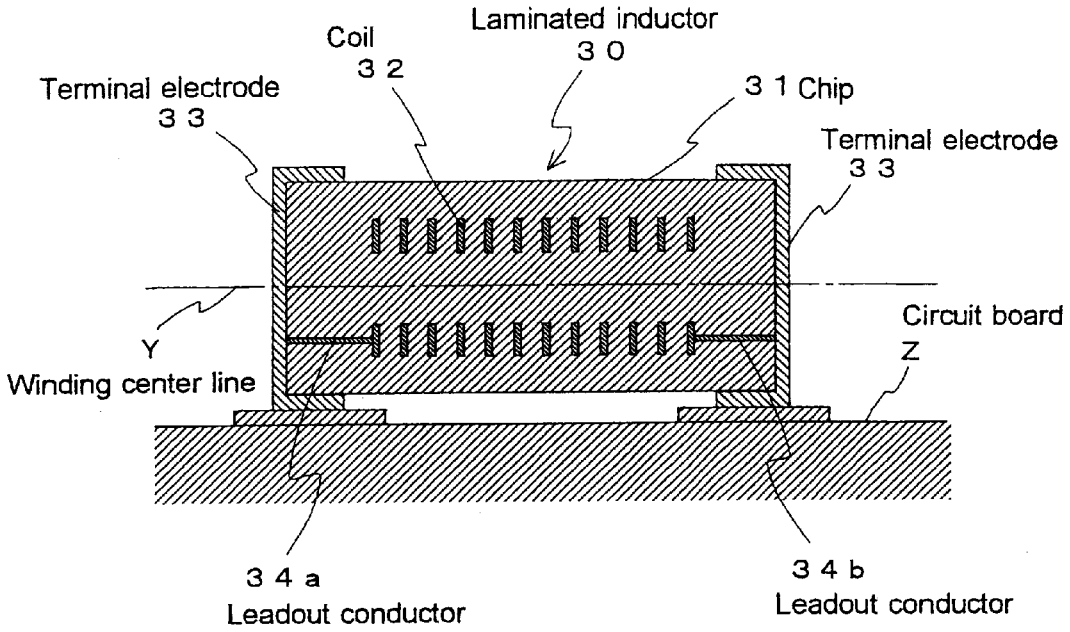
*Fig.* 9 Prior Art
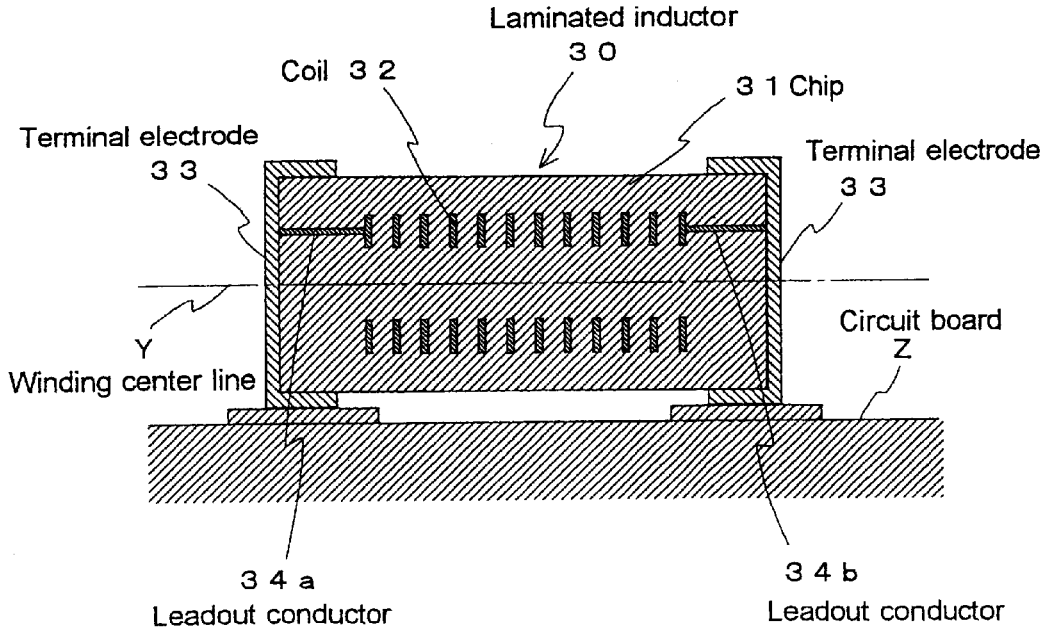

*Fig.* 10
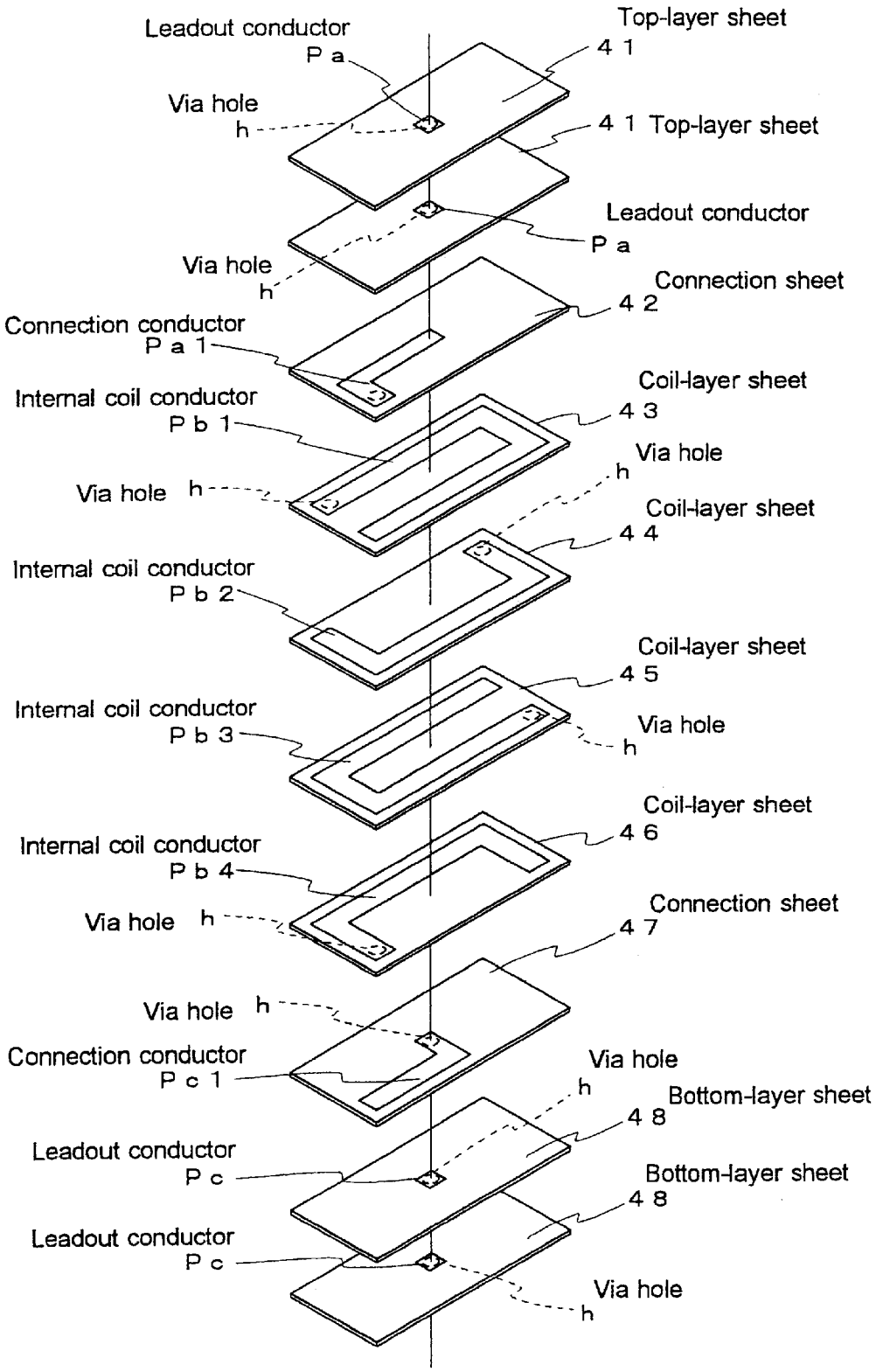

*Fig.* 11
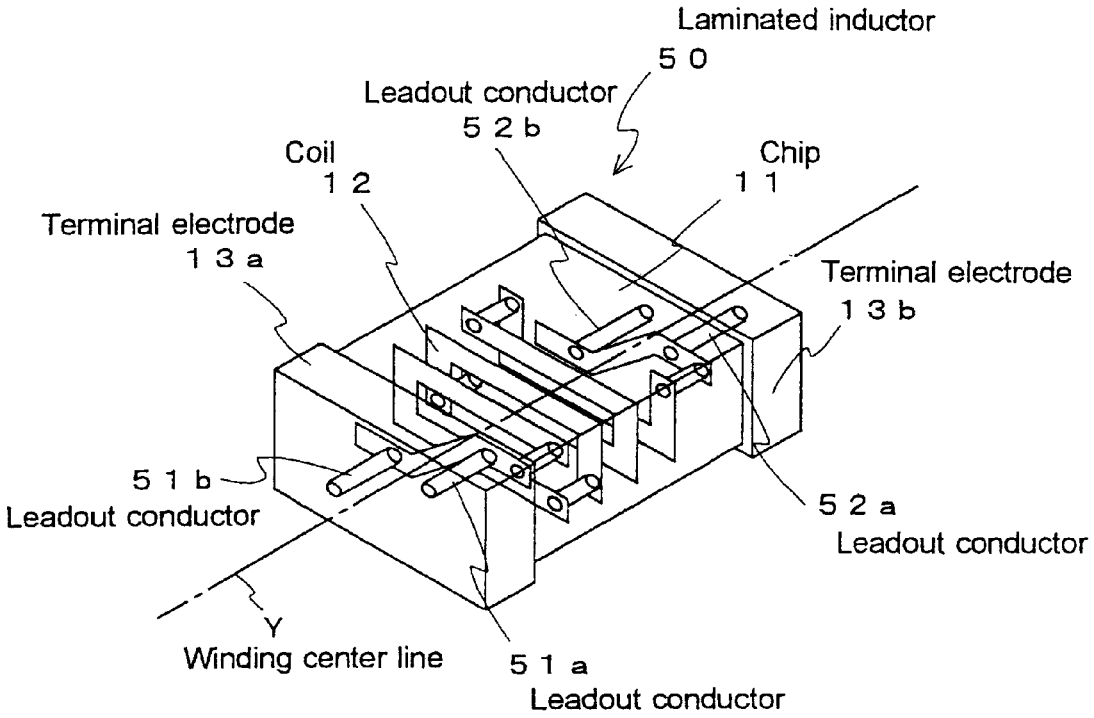

*Fig.* 1 2
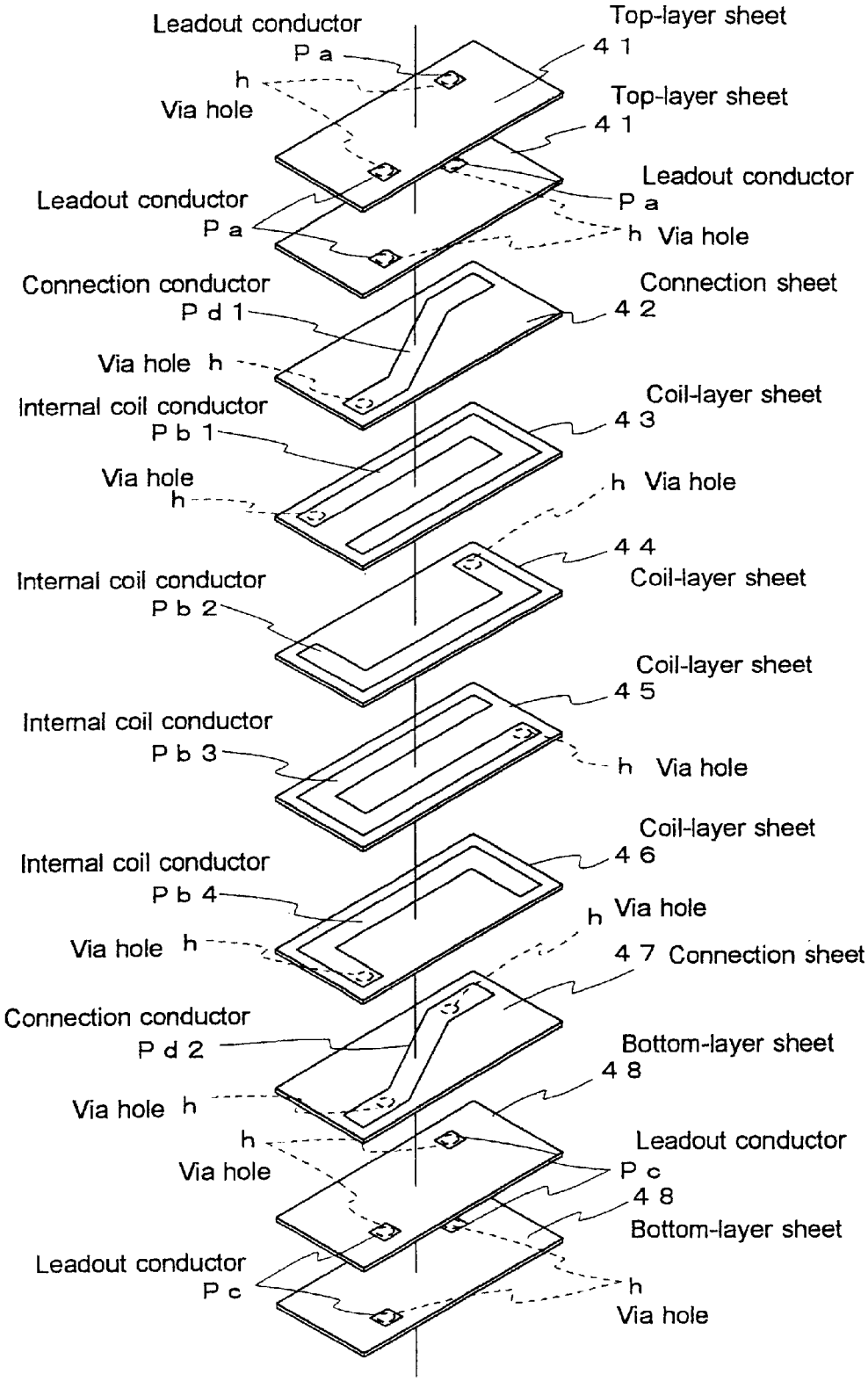

*Fig.* 13 a
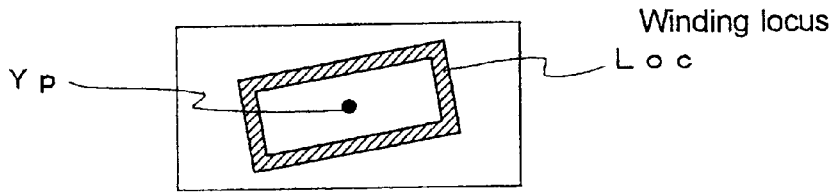
*Fig.* 13 b
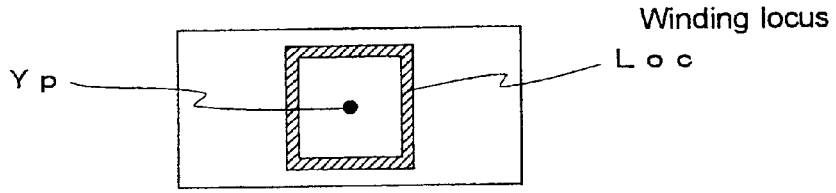
*Fig.* 13 c
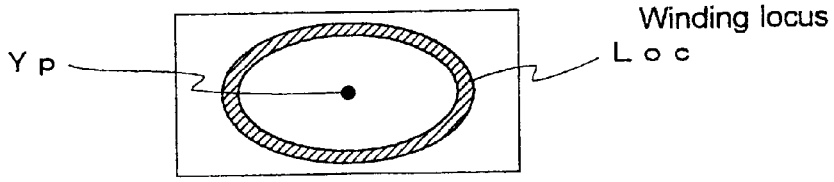

*Fig.* 13 d
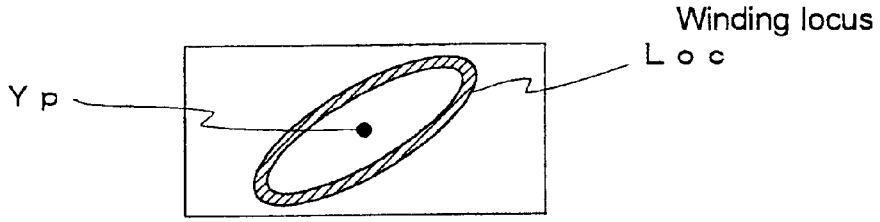
*Fig.* 13 e
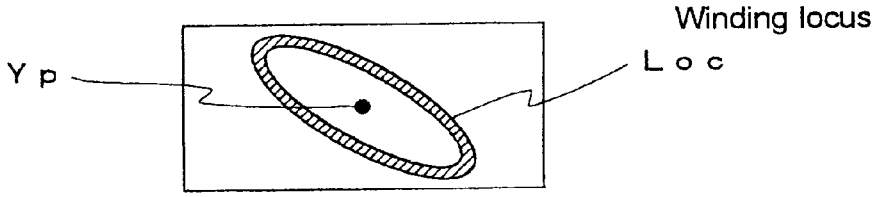
*Fig.* 13 f
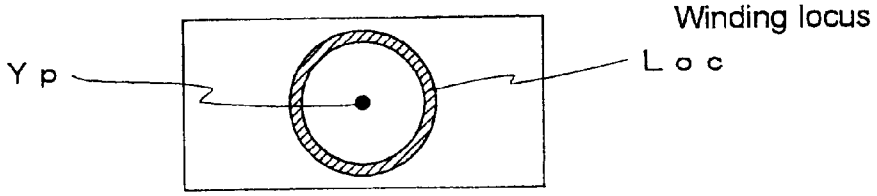

*Fig.* 14
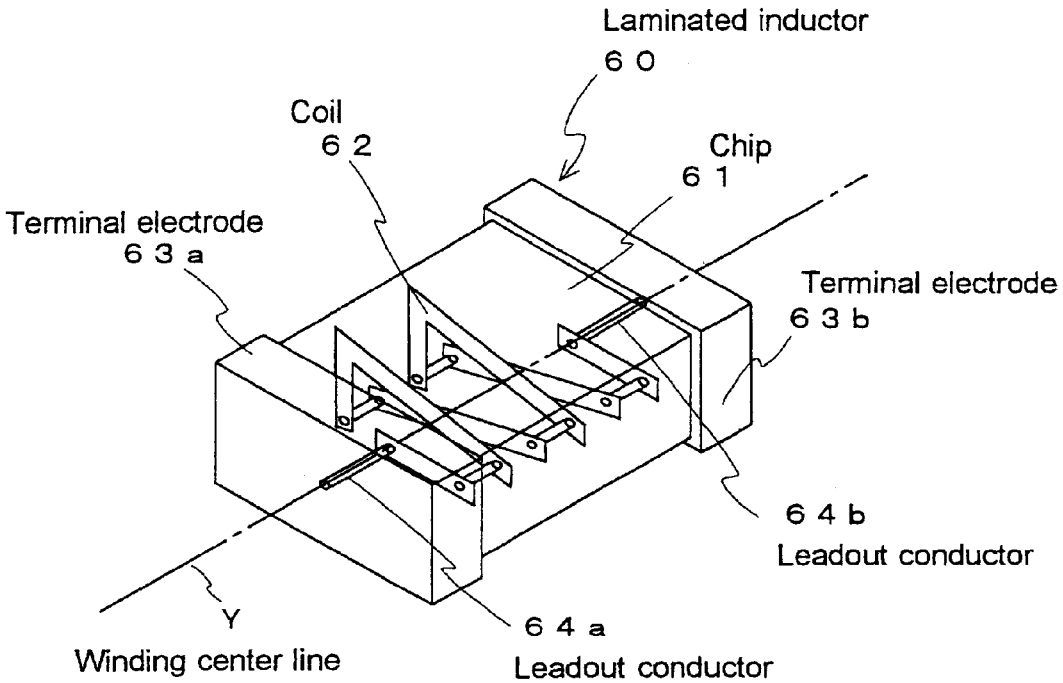
*Fig.* 15
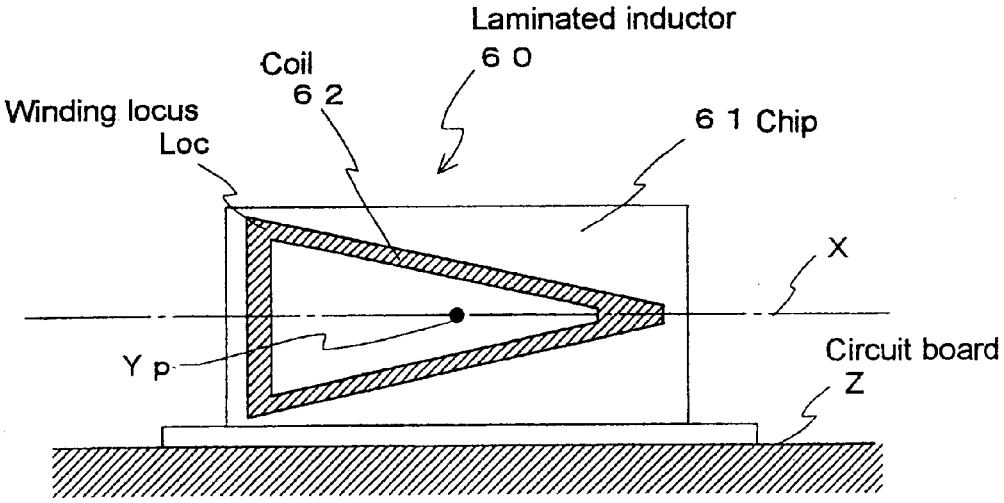

*Fig.* 16
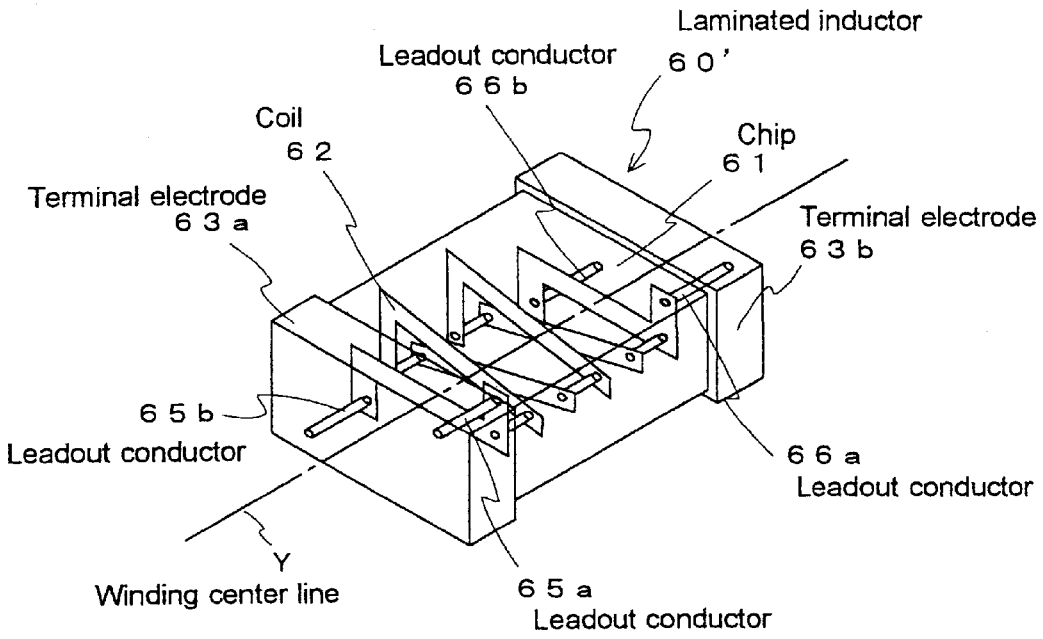
*Fig.* 17
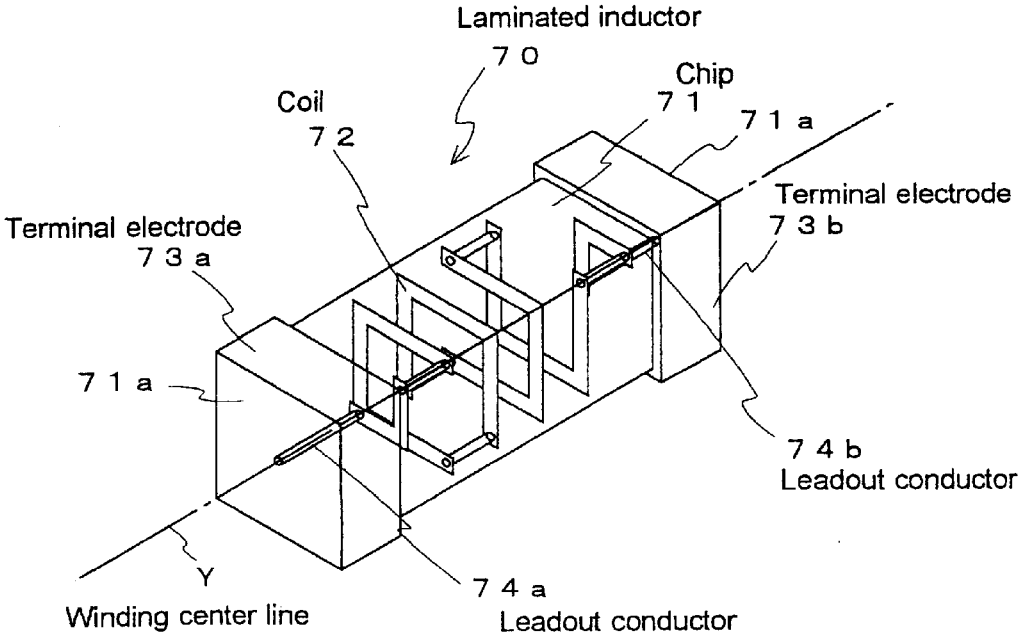

*Fig.* 18
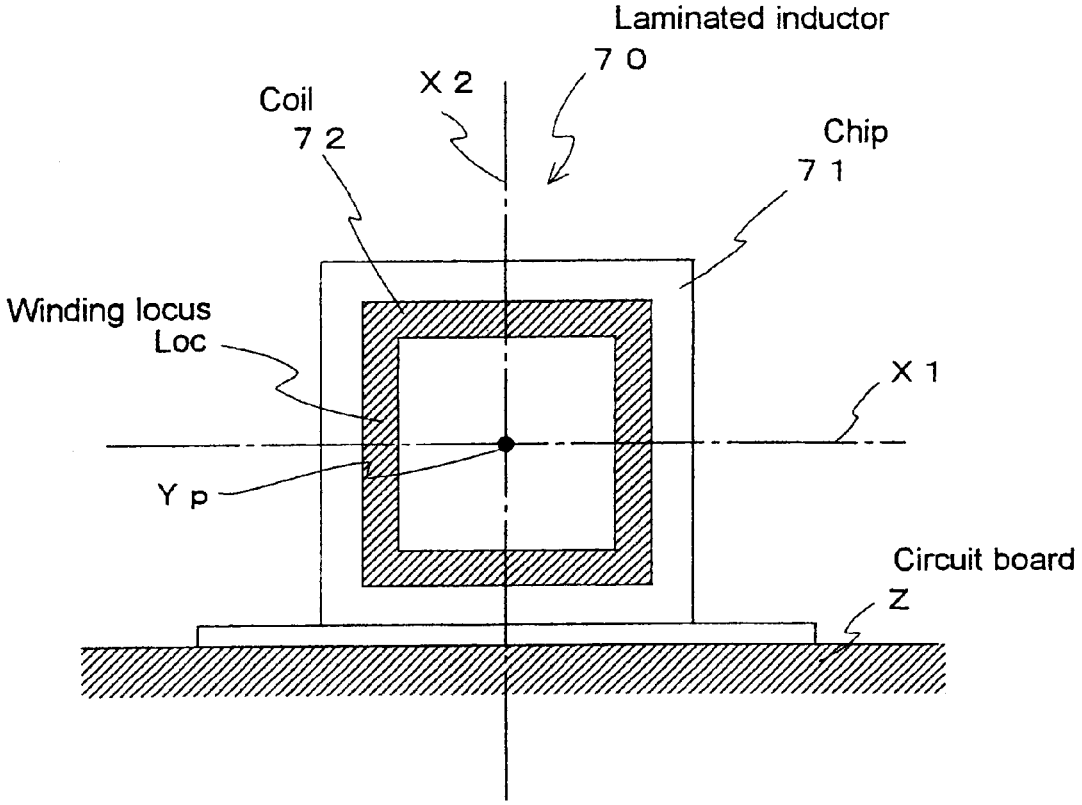

*Fig.* 19
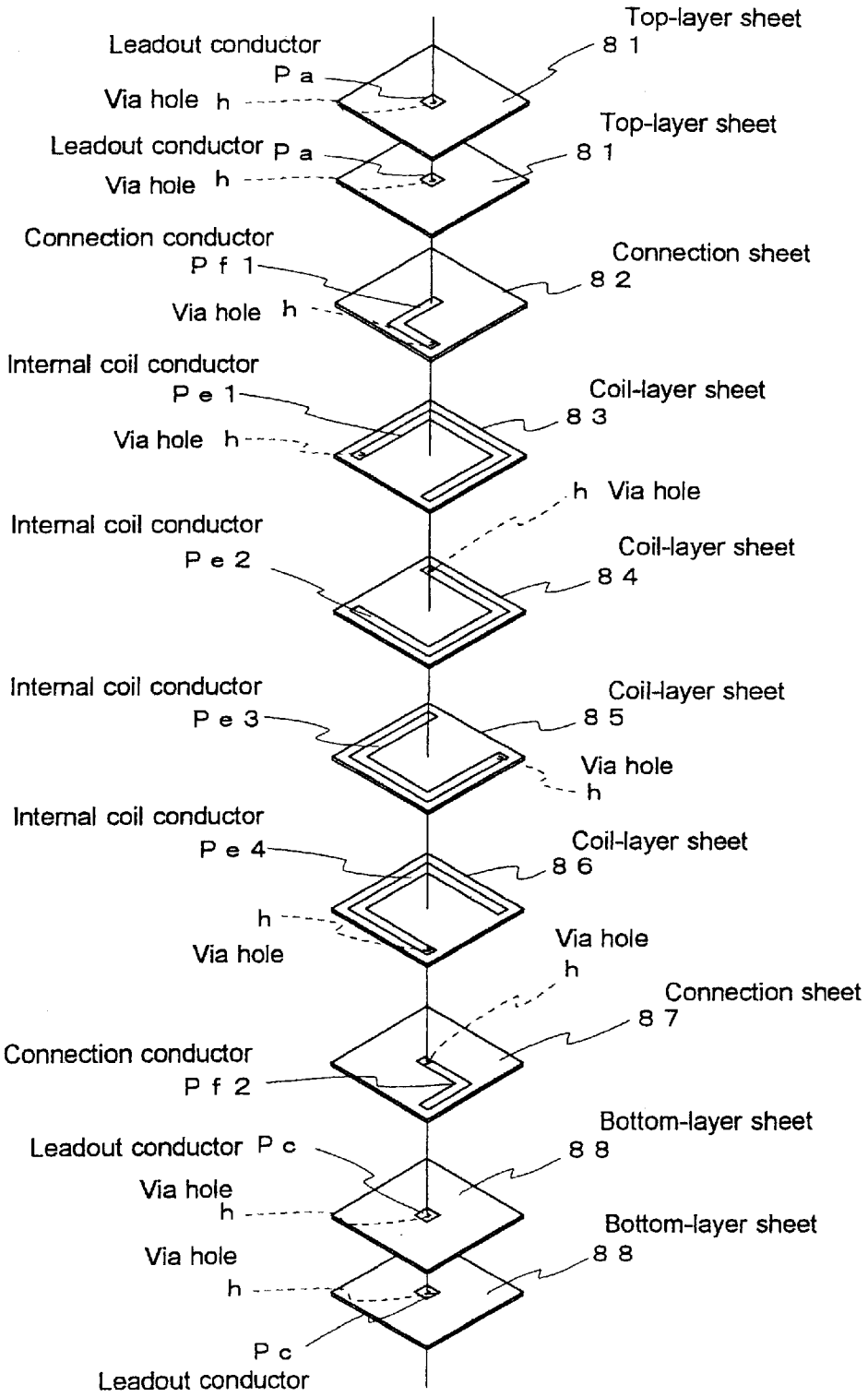

*Fig.* 20
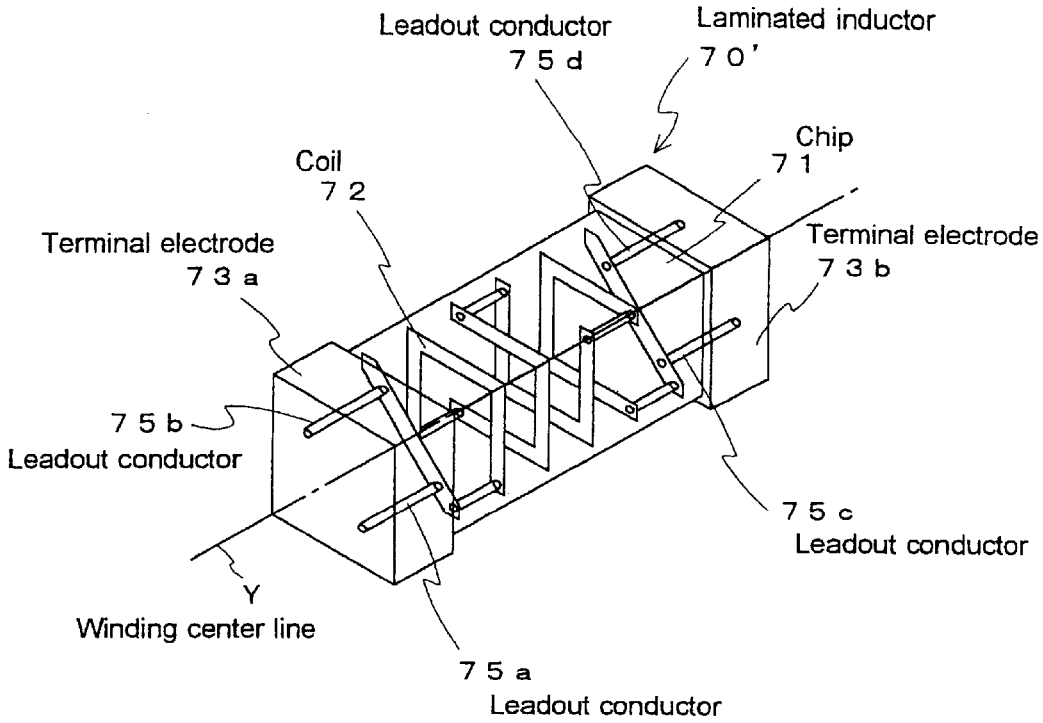
*Fig.* 21
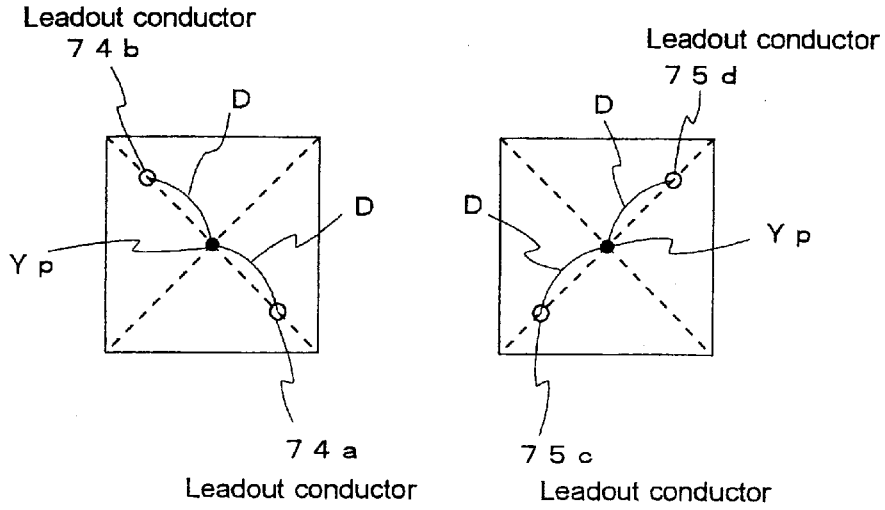

*Fig.* 22
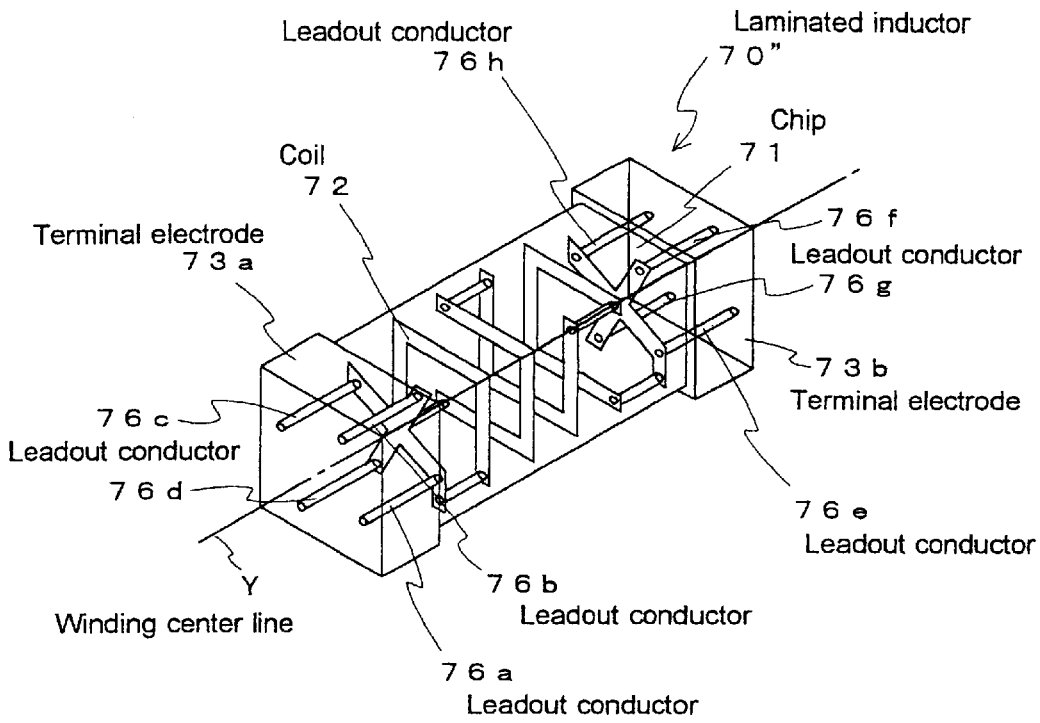
*Fig.* 23
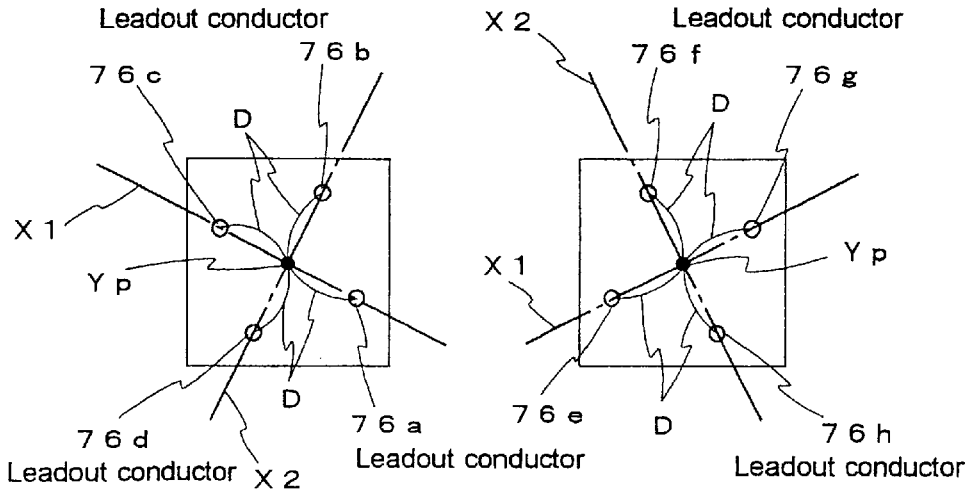

*Fig.* 24
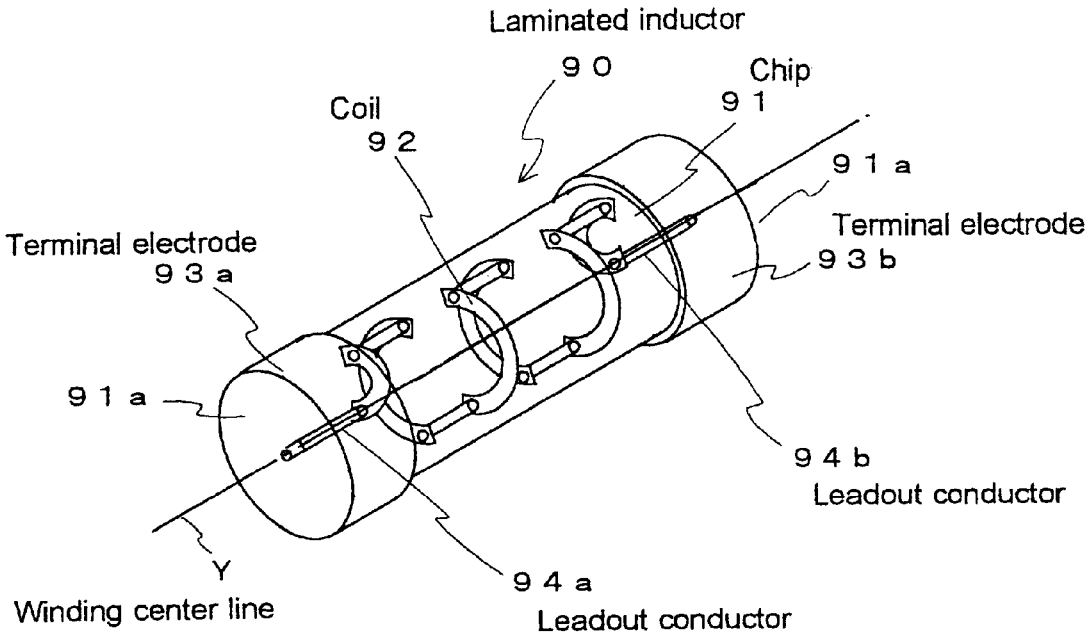
*Fig.* 25
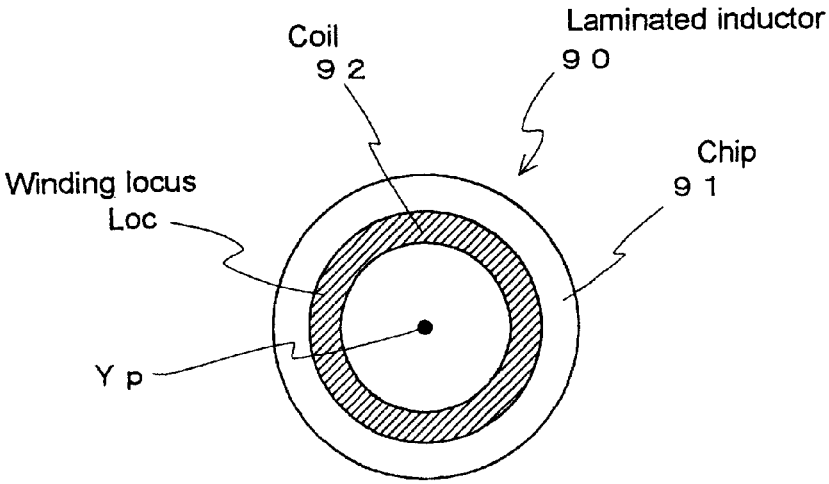

*Fig.* 26
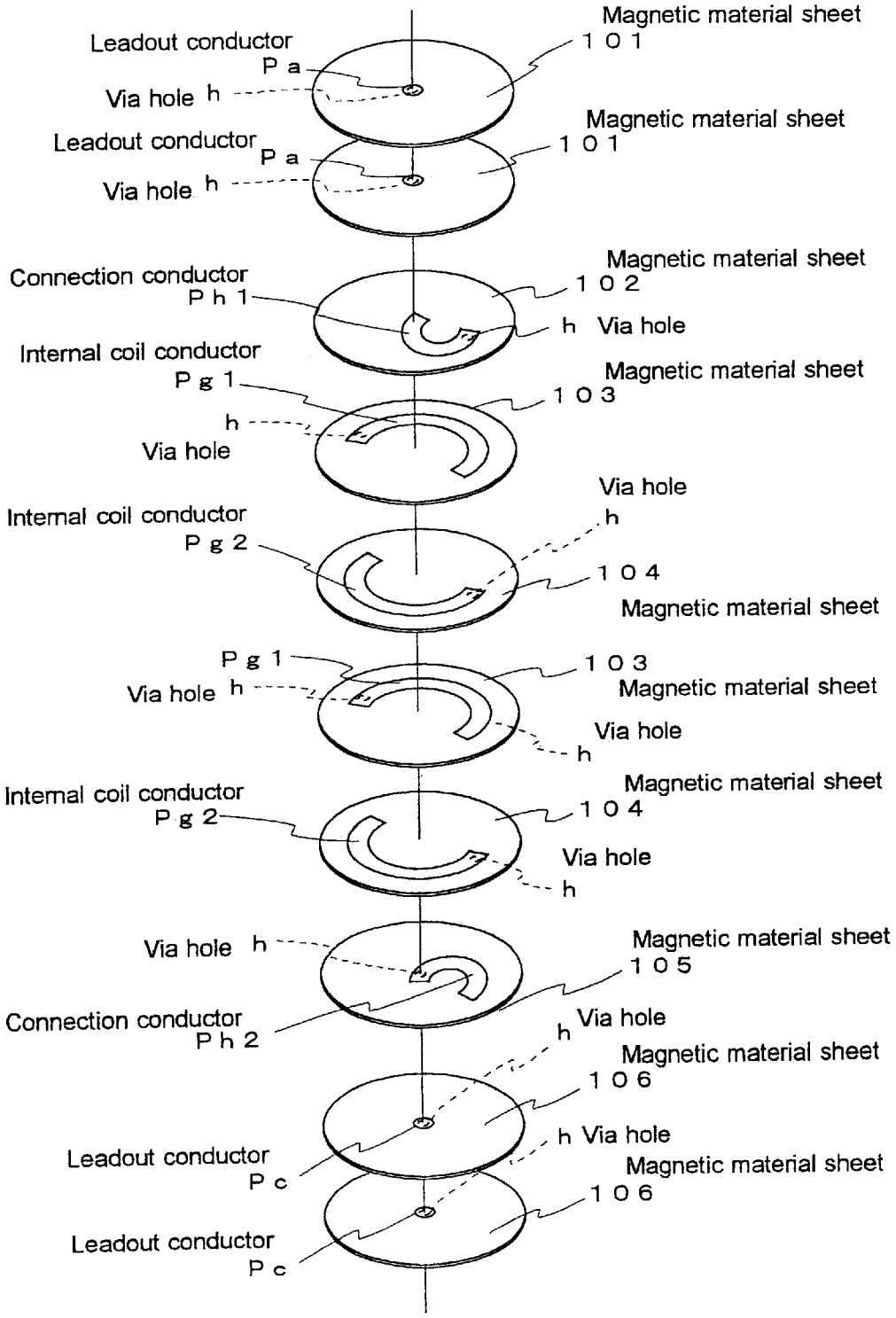

*Fig.* 27
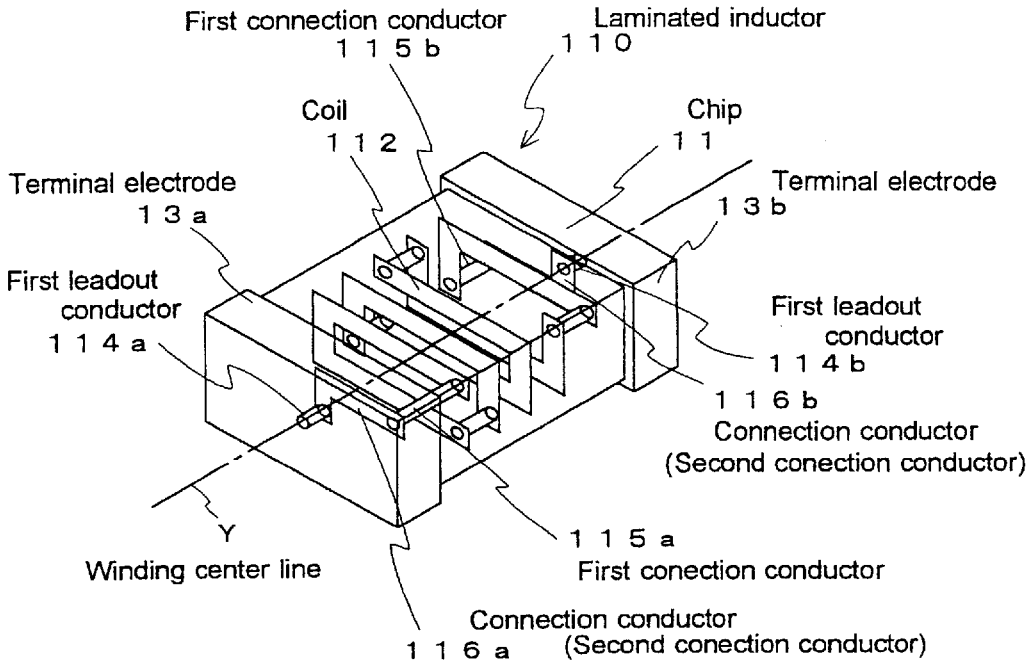
*Fig.* 28
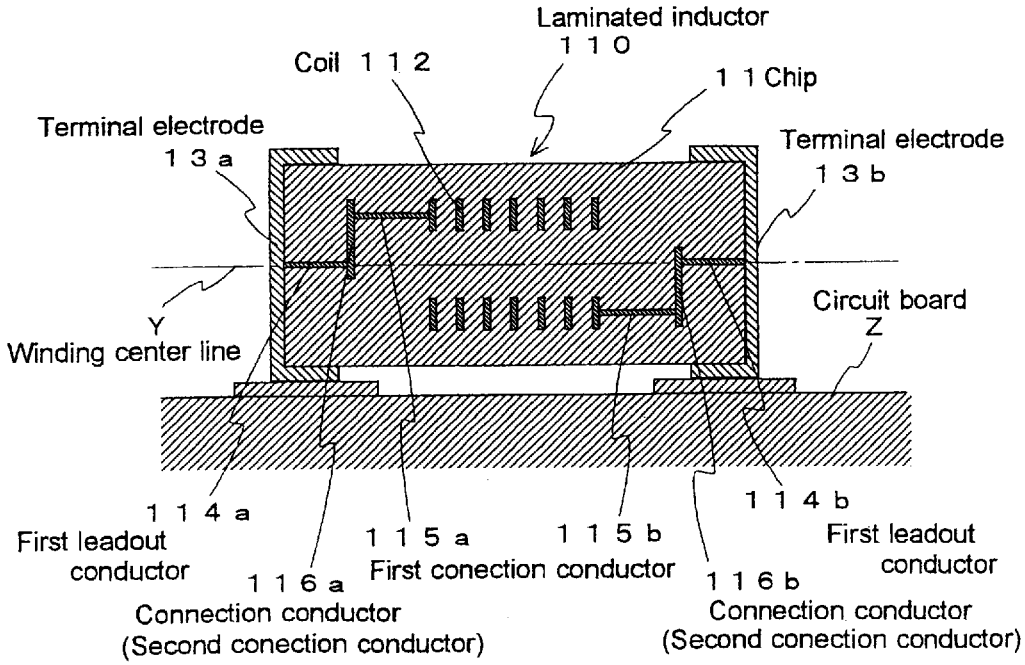

*Fig.* 29
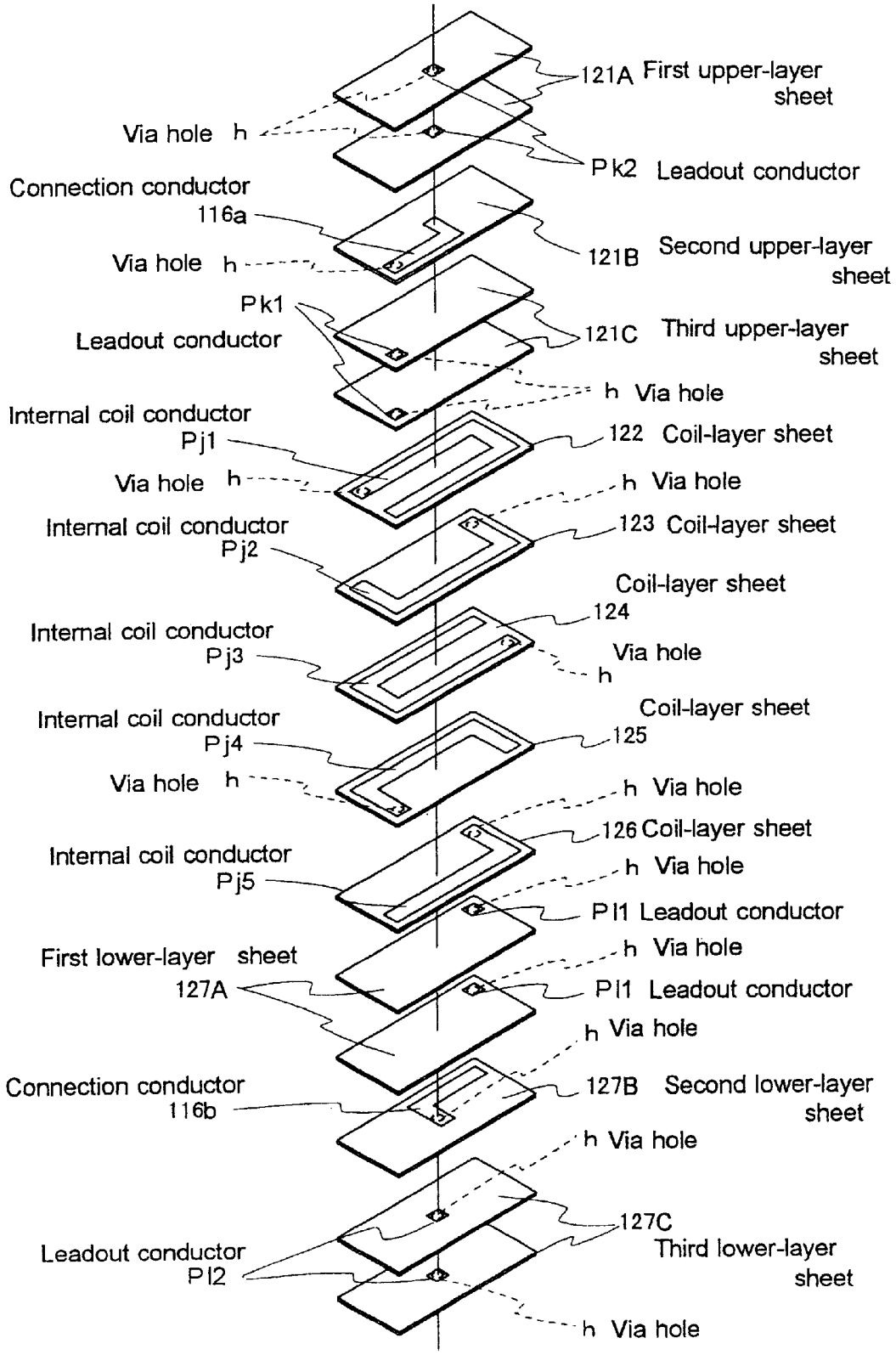

*Fig.* 30
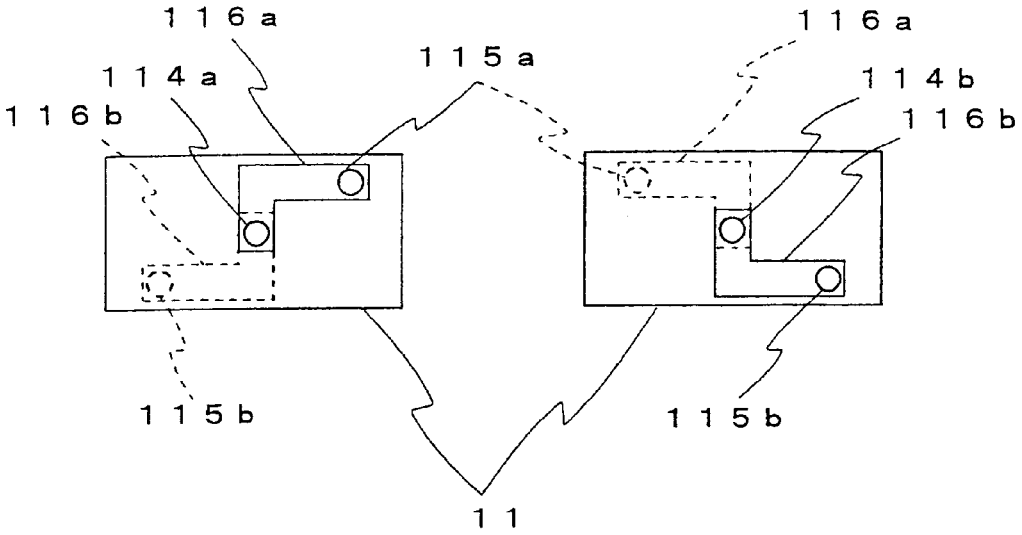
*Fig.* 31
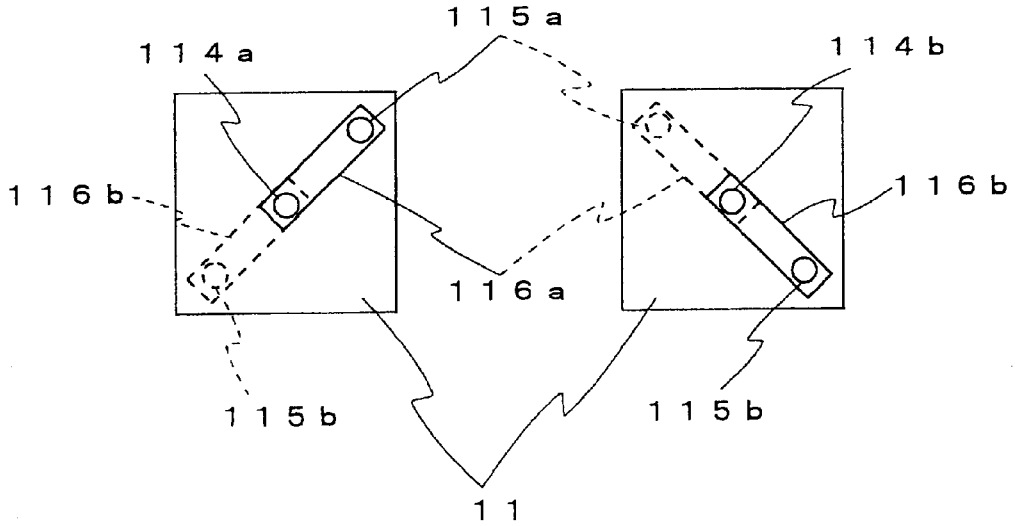

*Fig.* 32
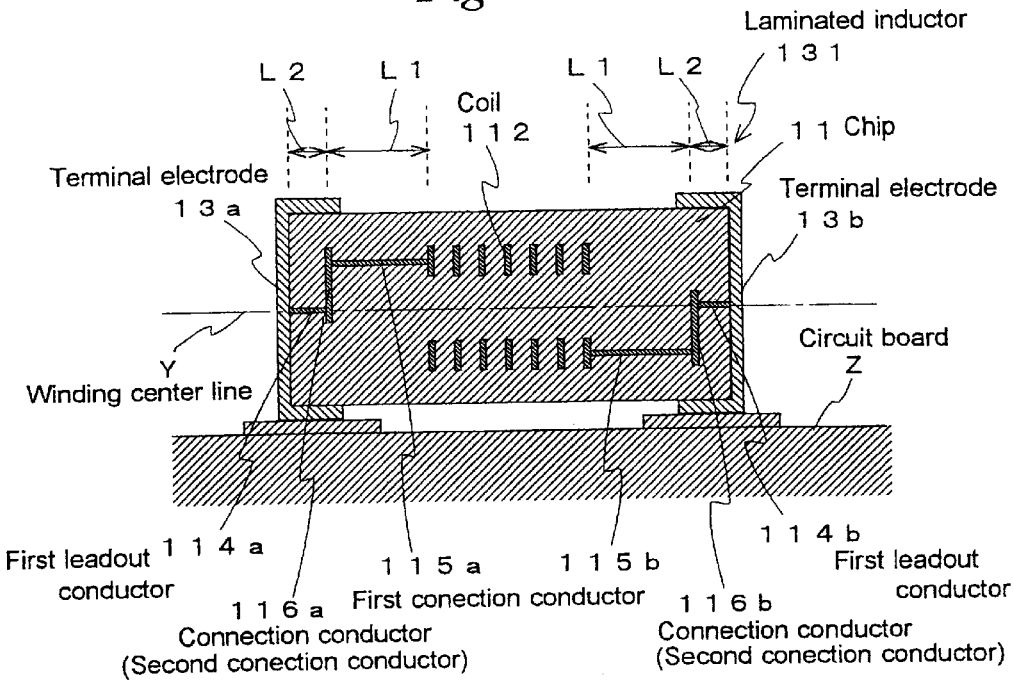
*Fig.* 33
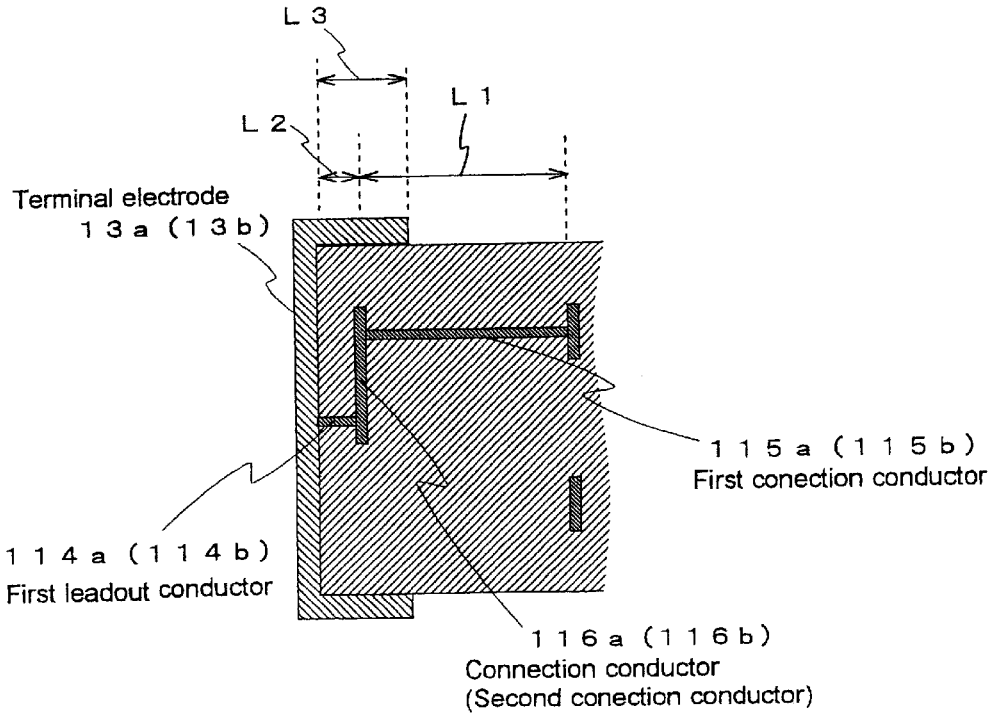

*Fig.* 34
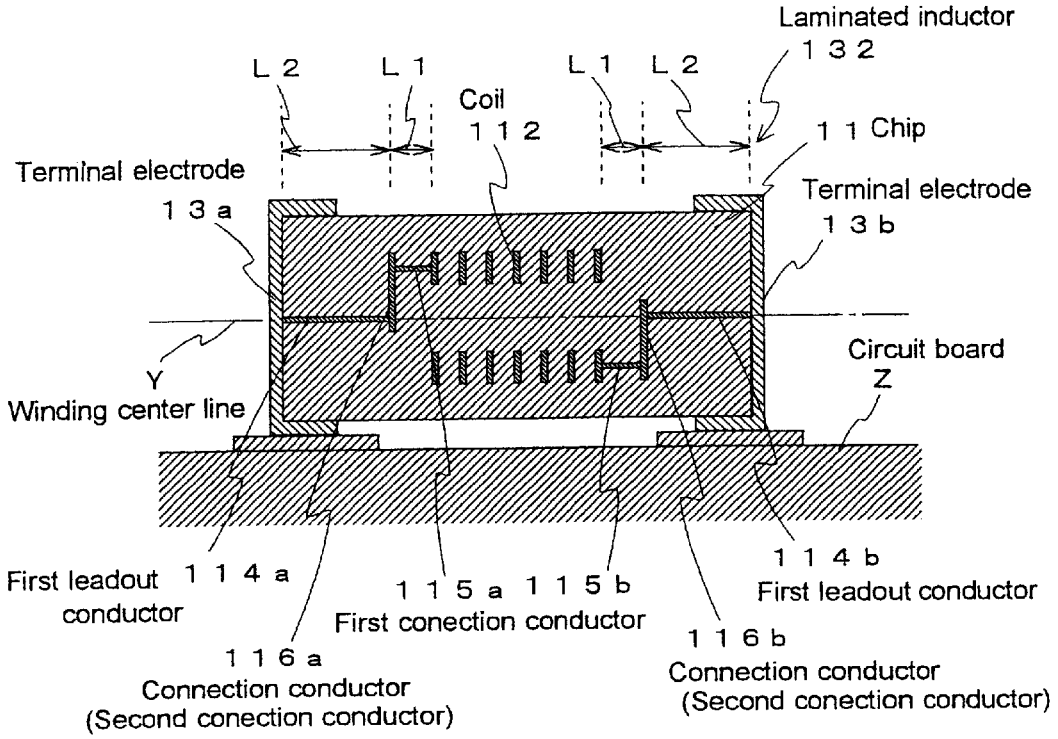
*Fig.* 35
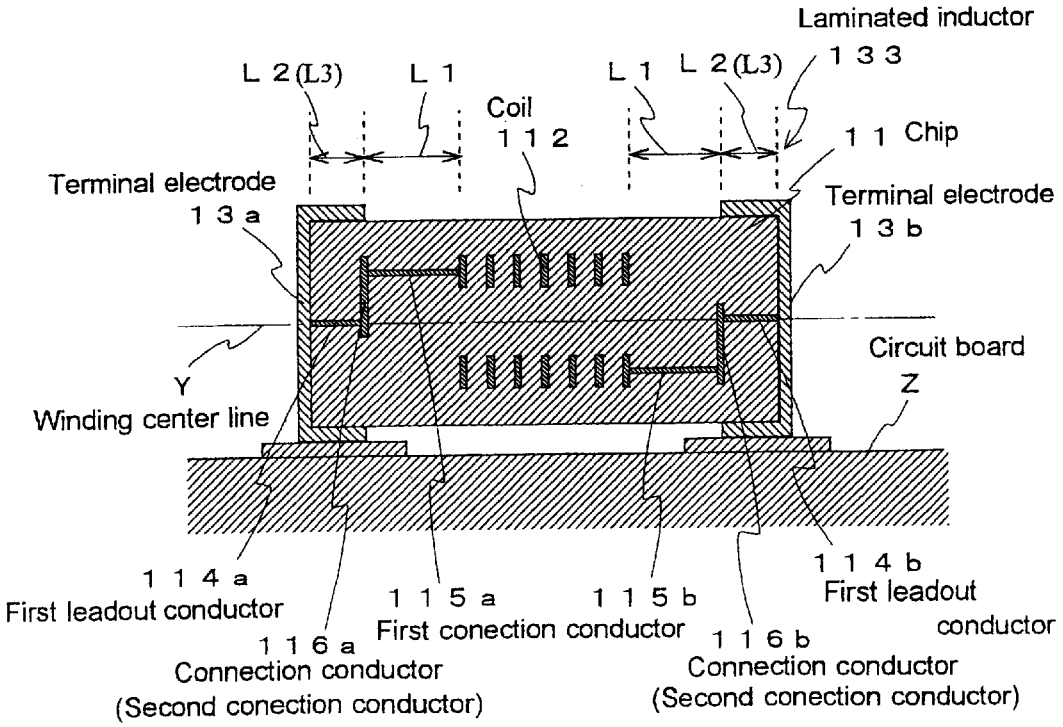

*Fig.* 36
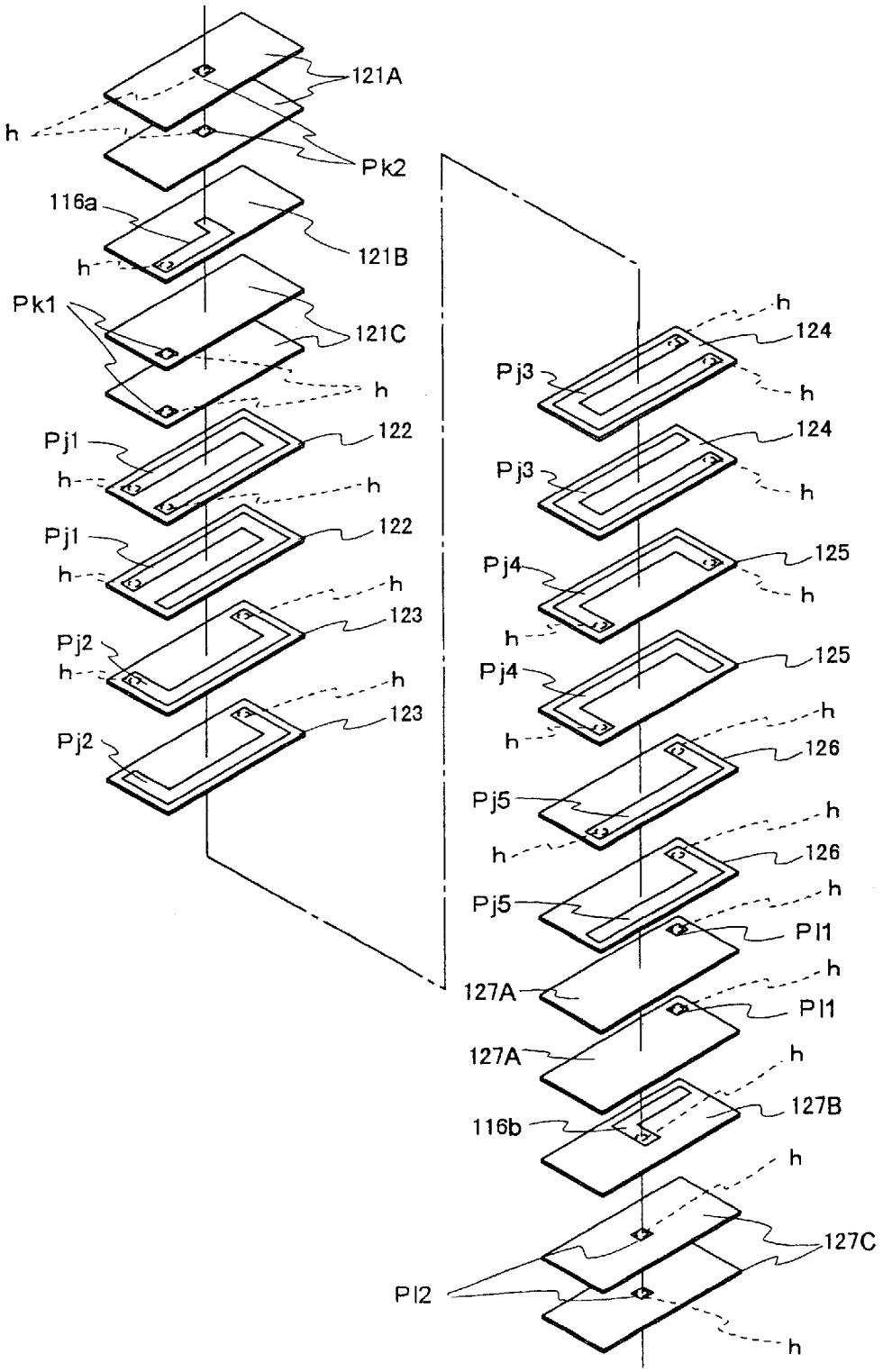

*Fig.* 37
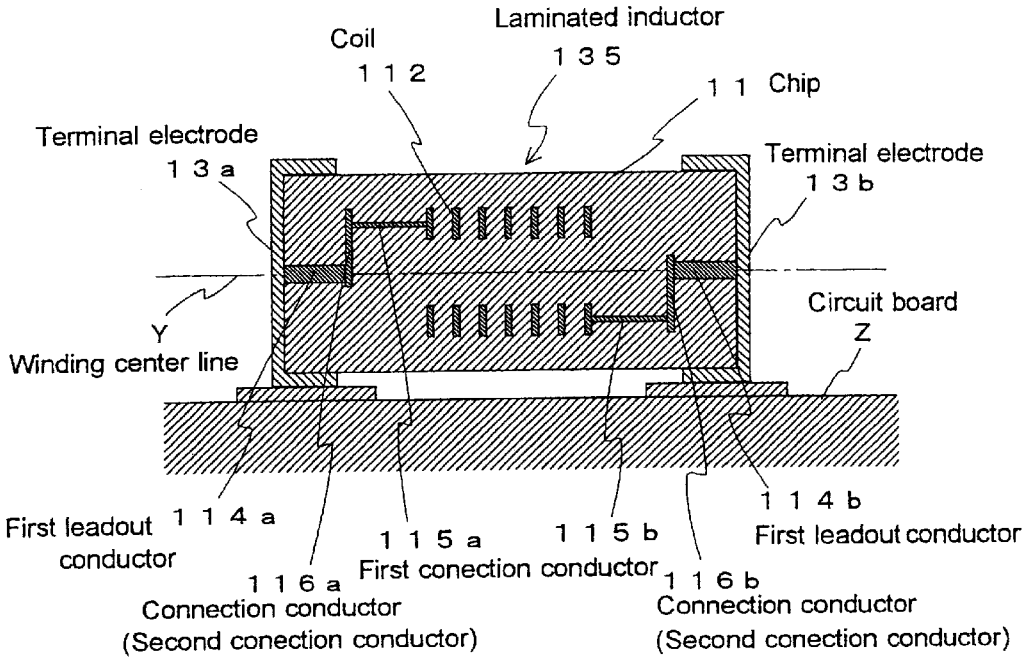
*Fig.* 38
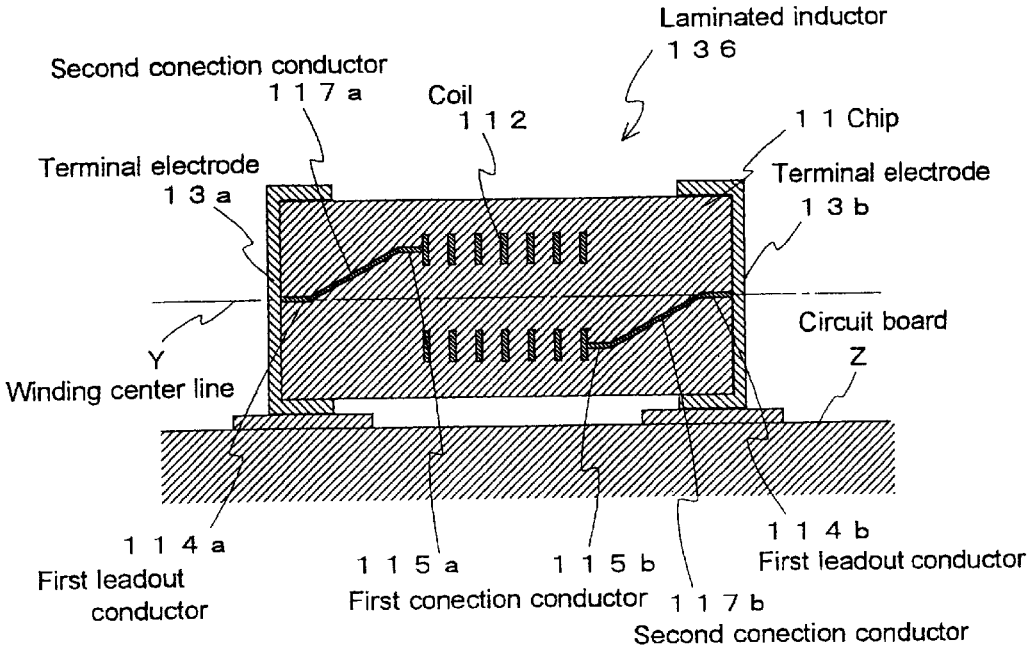

*Fig.* 39
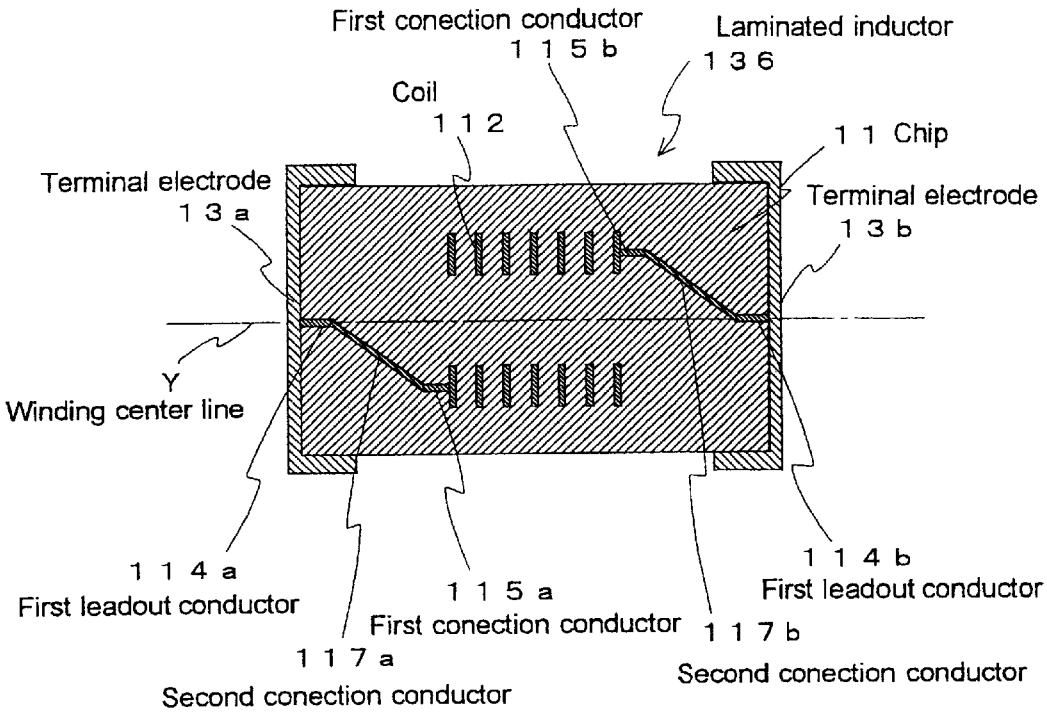

*Fig.* 40
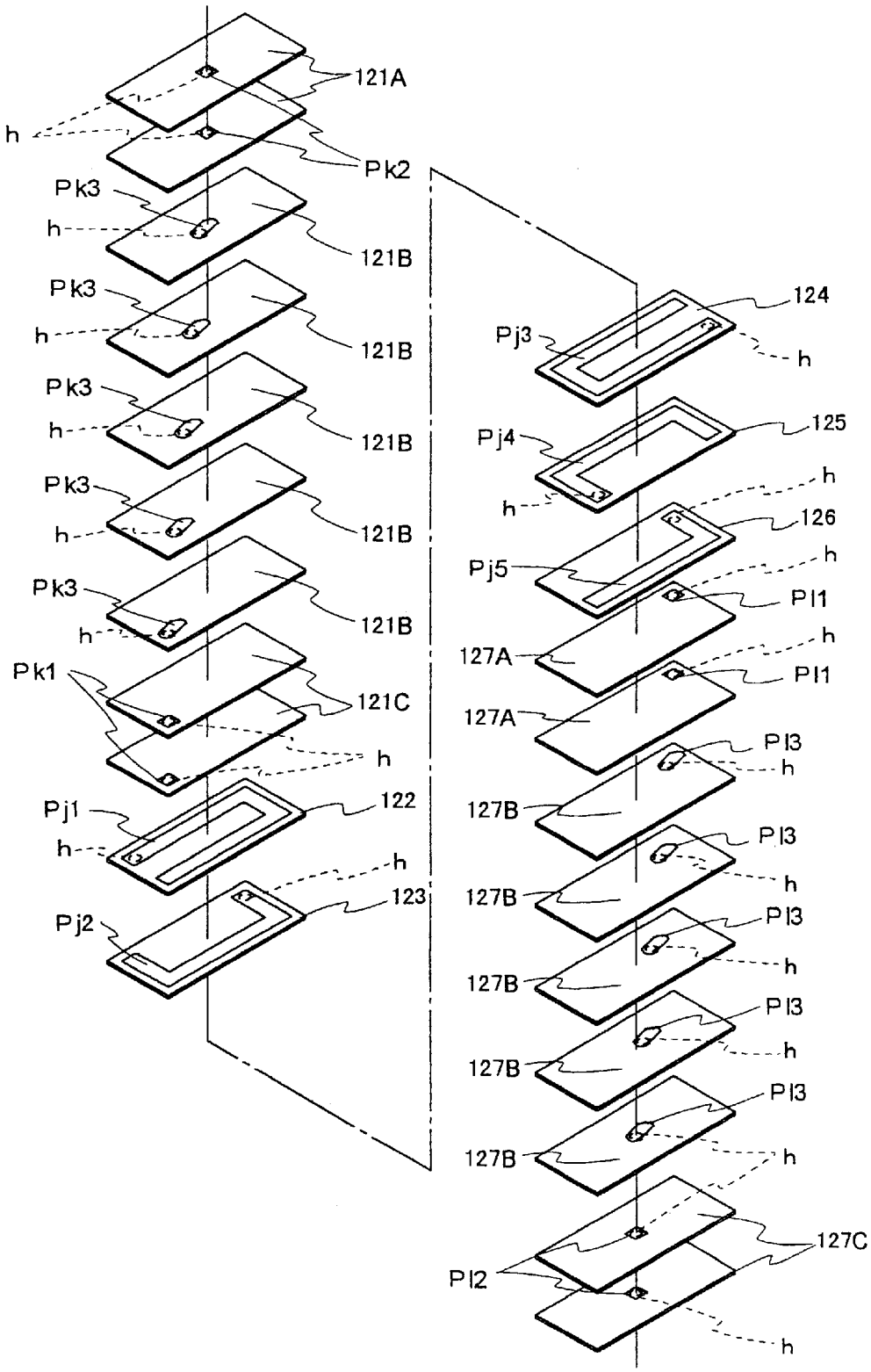

*Fig.* 41
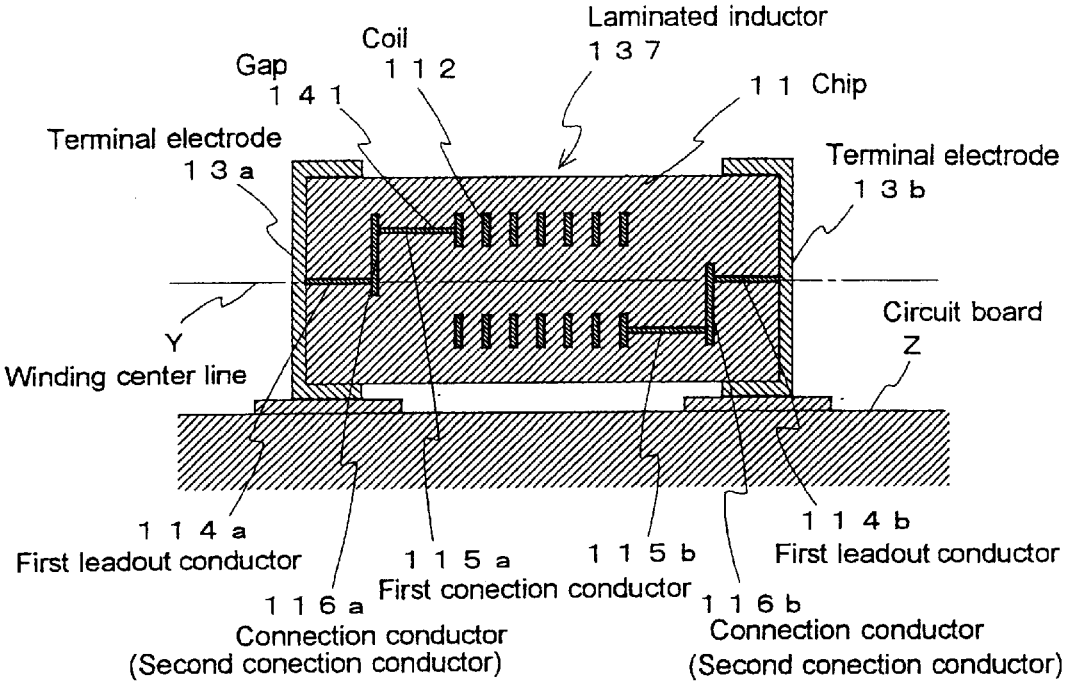
*Fig.* 42
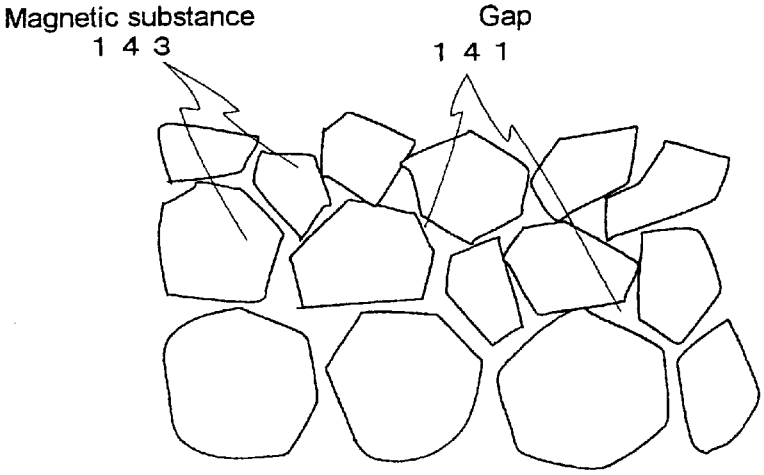

*Fig.* 43
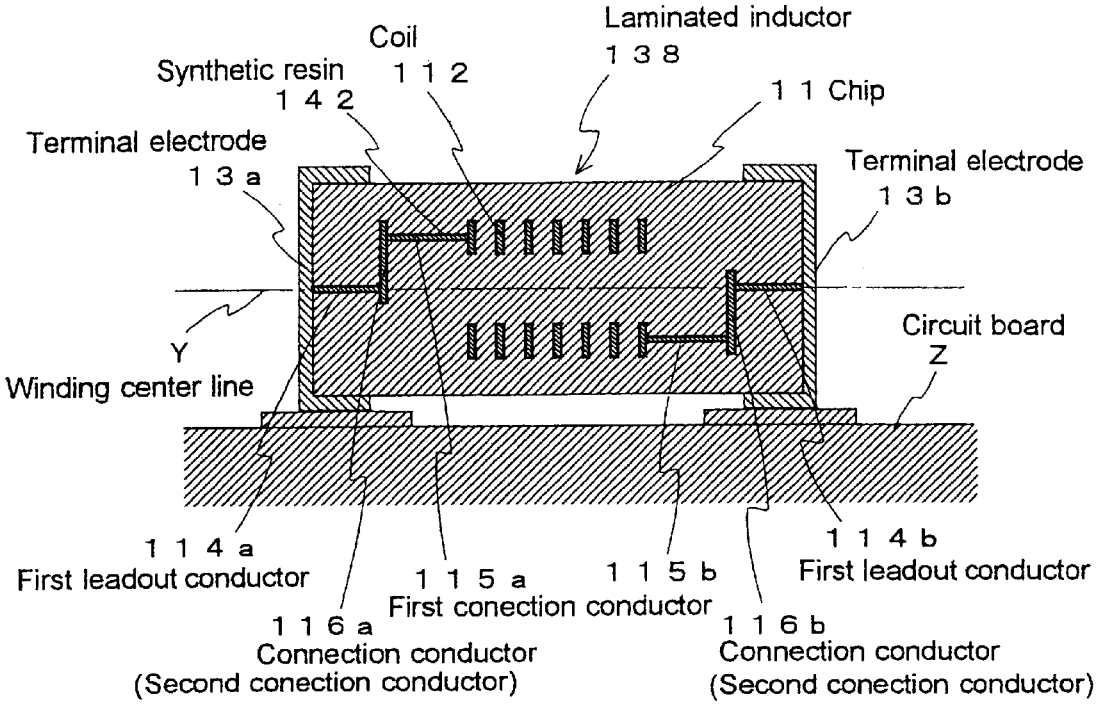
*Fig.* 44
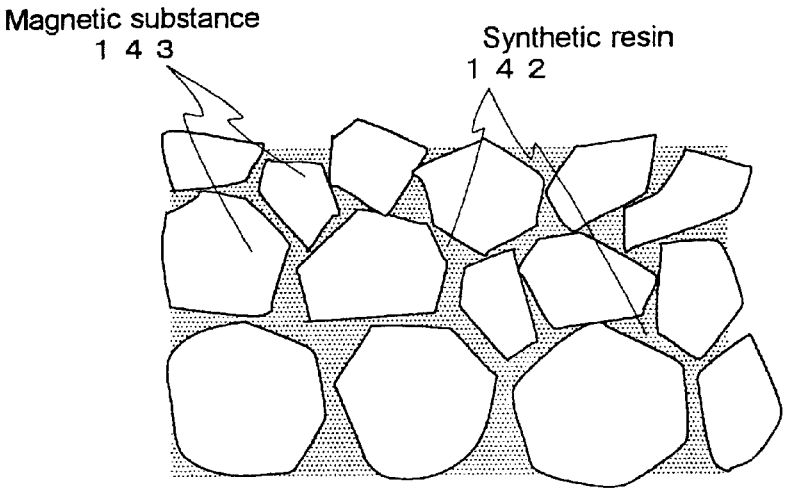

ELECTRONIC COMPONENTS

BACKGROUND OF THE INVENTION

1. Field of the Invention

The present invention elates to an electronic component comprising one or more coils buried in a chip.

2. Description of the Related Art

FIG. 2 shows a side sectional view of a laminated inductor as a conventional electronic component on this head.

In FIG. 2, 20 is a laminated inductor comprising a rectangular-parallelepiped-shaped chip 21 of a magnetic substance material, a spiral coil 22 buried in the chip 21, and a pair of terminal electrodes 23 provided at the longitudinal ends of the chip 21. The winding center line, i.e., longitudinal axis, Y of the coil 22 is orthogonal to a line joining the terminal electrodes 23 together (extending in the longitudinal direction of the chip), and the end of the coil 22 is guided out to the end surface of the chip where it is connected to the respective terminal electrode 23.

To mount the laminated inductor 20 on a conductor pattern on a circuit board, two orientations are available in which the winding center line (Y) of the coil 22 is perpendicular to the mounting surface of the circuit board (Z) as shown in FIG. 3 and in which winding the center line (Y) of the coil 22 is parallel with the mounting surface of the circuit board (Z) as shown in FIG. 4.

There is a difference in inductance between the mounting orientations in FIGS. 3 and 4 due to the different locational relationship between the coil 22 and the circuit board (Z) resulting in a difference in magnetic reluctance to magnetic fluxes outside the chip. In particular, in a laminated inductor using a chip material of a lower relative magnetic permeability, the difference in mounting orientation causes a significant difference in magnetic reluctance and thus a relatively large difference in inductance.

To solve such a problem, a laminated inductor has been proposed in which the orientation of the winding center line of the coil relative to the surface of the circuit board remains unchanged regardless of the mounting orientation (Japanese Patent Application Laid-Open No. 8-55726).

This laminated inductor is generally called a vertically laminated inductor wherein a laminated structure is formed in the direction of a line joining the terminal electrodes together as shown in FIGS. 5 to 7.

A chip 31 in a vertically laminated inductor 30, which is shown in FIGS. 5 to 7, is formed by laminating a top-layer sheet (A) of a magnetic material, coil-layer sheets (B1) to (B4) of a magnetic material, and a bottom-layer sheet (C) of a magnetic material. A leadout conductor (Pa) is formed in the top layer-sheet (A) of a magnetic material in such a way as to overlap a via hole (h). Four types of approximately-U-shaped coil conductors (Pb1) to (Pb4) are formed in the coil-layer sheets (B1) to (B4) of a magnetic material in such a way that their ends overlap the via hole (h). In addition, a rectangular leadout conductor (Pc) is formed in the bottom-layer sheet (C) of a magnetic material in such a way as to overlap the via hole (h). Furthermore, terminal electrodes 33 are formed at the respective ends of the chip 31 in the lamination direction to constitute the vertically laminated inductor 30.

The coil conductors (Pb1) to (Pb4) are connected together via the via hole (h) to form the coil 32, and the respective ends of the coil 32 are connected to the terminal electrodes 33 via leadout conductors 34*a* and 34*b* consisting of leadout conductors (Pa) and (Pc) formed in the top- and bottom-layer sheets (A) and (C) of a magnetic material.

In the vertically laminated inductor 30 of the configuration shown in FIGS. 5 to 7, when a current flows through the inductor, two fluxes are generated; one of them is parallel with the winding center line (Y) of the coil 32, while the other rotates around the leadout conductors 34*a* and 34*b*. These magnetic fluxes form the inductance of the chip.

When, however, the laminated inductor 30 is mounted on the circuit board (Z), there is a difference in distance between the leadout conductor 34*a* or 34*b* and the circuit board (Z), between the mounting orientation shown in FIG. 8 and the mounting orientation shown in FIG. 9 in which the inductor is vertically revered. Consequently, there is a difference in magnetic reluctance to magnetic fluxes generated around the leadout conductors 34*a* and 34*b*, resulting in a difference in inductance depending on the mounting orientation.

BRIEF SUMMARY OF THE INVENTION

It is an object of the present invention to provide an electronic component including a coil that avoids a difference in inductance depending on the mounting orientation.

The present invention provides an electronic component comprising a coil buried in a rectangular-parallelepiped-shaped chip and terminal electrodes located at the respective ends of the chip and connected to the respective ends of the coil, wherein the winding center line of the coil, i.e., the coil axis, is set on a straight line joining the central points of a pair of opposed end surfaces of the chip at which terminal electrodes are formed and wherein the winding locus of the coil as seen in the direction of the winding center line and leadout conductors each joining the end of the coil and the terminal electrode together are arranged at positions and/or in conditions such that when the electronic component is mounted on a circuit board, the winding locus of the coil and the distance between the leadout conductor and the circuit board remains unchanged at least despite the reversal of the electronic component.

In the electronic component of this configuration, the distances between the coil and the circuit board and between the leadout conductor and the circuit board remain unchanged whichever of the four surfaces of the chip different from its end surfaces is opposed to the circuit board, as long as, for example, a cross section of the chip perpendicular to the winding center line of the coil is square. Thus, the magnetic reluctance remains the same in each mounting orientation, thereby preventing the inductance provided by the coil and leadout conductors from being changed by the mounting orientation. Consequently, this electronic component precludes a difference in inductance depending on the mounting orientation. In addition, when the chip is shaped like a rectangular parallelepiped and the cross section of the chip perpendicular to the winding center line of the coil is not square, the distance between the leadout conductor and the circuit board remains unchanged despite the vertical reversal of the chip in mounting it on the circuit board. As a result, when the cross section of the chip perpendicular to the winding center line of the coil has a shape other than a square, the inductance remains unchanged despite the vertical reversal of the chip in mounting it on the circuit board.

Moreover, the present invention provides an electronic component wherein the inductance remains unchanged regardless of the mounting orientation even if the chip is shaped like a cylinder as described above. For example, the present invention provides an electronic component comprising a coil buried in a cylinder-shaped chip and terminal electrodes located at the respective ends of the chip and connected to the respective ends of the coil, wherein the winding center line of the coil is set on a straight line joining the central points of a pair of opposed end surfaces of the chip at which terminal electrodes are formed, wherein the distance between the winding locus of the coil as seen in the direction of the winding center line and the central point through which the winding center line of the coil passes remains constant in any cross section of the chip which the winding center line of the coil crosses perpendicularly, and wherein at either end of the chip, a leadout conductor joining the end of the coil and the terminal electrode together is located on the winding center line of the coil.

BRIEF DESCRIPTION OF THE DRAWINGS

FIG. 1 is a perspective view of a laminated inductor according to a first embodiment of the present invention;

FIG. 2 is a side sectional view of a laminated inductor according to a conventional example;

FIG. 3 is a perspective of how a conventional laminated inductor is mounted;

FIG. 4 is a perspective of how a conventional laminated inductor is mounted;

FIG. 5 is a side sectional view of a vertically laminated inductor according to a conventional example;

FIG. 6 is a perspective view of a vertically laminated inductor according to a conventional example;

FIG. 7 is a exploded perspective view of a laminated structure of a vertically laminated inductor according to a conventional example;

FIG. 8 is a side sectional view of how a laminated inductor is mounted according to a conventional example;

FIG. 9 is a side sectional view of how a laminated inductor is mounted according to a conventional example;

FIG. 10 is an exploded perspective view of a laminated structure of the laminated inductor according to the first embodiment of the present invention;

FIG. 11 is a perspective view of a laminated inductor according to a second embodiment of the present invention;

FIG. 12 is an exploded perspective view of the laminated structure of the laminated inductor according to the second embodiment of the present invention;

FIGS. 13*a* to 13*f* show the winding locus of another coil according to the second embodiment of the present invention;

FIG. 14 is a perspective view showing a laminated inductor according to a third embodiment of the present invention;

FIG. 15 shows the winding locus of a coil according to the third embodiment of the present invention as seen in the direction of the winding center line of the coil;

FIG. 16 is a perspective view showing a laminated inductor according to a fourth embodiment of the present invention;

FIG. 17 is a perspective view showing a laminated inductor according to a fifth embodiment of the present invention;

FIG. 18 shows the winding locus of a coil according to the fifth embodiment of the present invention as seen in the direction of the winding center line of the coil;

FIG. 19 is an exploded perspective view showing the laminated structure of the laminated inductor according to the fifth embodiment of the present invention;

FIG. 20 is a perspective view showing a laminated inductor according to a sixth embodiment of the present invention;

FIG. 21 shows positions at which leadout conductors are formed according to the sixth embodiment of the present invention;

FIG. 22 is a perspective view showing a laminated inductor according to a seventh embodiment of the present invention;

FIG. 23 shows a position at which leadout conductors are formed according to the seventh embodiment of the present invention;

FIG. 24 is a perspective view showing a laminated inductor according to an eighth embodiment of the present invention;

FIG. 25 shows the winding locus of a coil according to the eighth embodiment of the present invention as seen in the direction of the winding center line of the coil; and FIG. 26 is an exploded perspective view showing the laminated structure of the laminated inductor according to the eighth embodiment of the present invention;

FIG. 27 is a perspective view showing a laminated inductor according to a ninth embodiment of the present invention;

FIG. 28 is a side sectional view showing a laminated inductor according to the ninth embodiment of the present invention;

FIG. 29 is an exploded perspective view showing the laminated structure according to the ninth embodiment of the present invention;

FIG. 30 shows the arrangement of a leadout conductor as seen in the direction of the center line of a coil according to the ninth embodiment of the present invention;

FIG. 31 shows another example of the leadout conductor according to the ninth embodiment of the present invention;

FIG. 32 is a side sectional view showing a laminated inductor according to a tenth embodiment of the present invention;

FIG. 33 shows another example for setting the length of a first leadout conductor according to the tenth embodiment of the present invention;

FIG. 34 is a side sectional view showing a laminated inductor according to an eleventh embodiment of the present invention;

FIG. 35 is a side sectional view showing a laminated inductor according to a twelfth embodiment of the present invention;

FIG. 36 is an exploded perspective view showing a laminated structure of a laminated inductor according to a thirteenth embodiment of the present invention;

FIG. 37 is a side sectional view showing a laminated inductor according to a fourteenth embodiment of the present invention;

FIG. 38 is a side sectional view showing a laminated inductor according to a fifteenth embodiment of the present invention;

FIG. 39 is a top sectional view showing the laminated inductor according to the fifteenth embodiment of the present invention;

FIG. 40 is an exploded perspective view showing the laminated structure of the laminated inductor according to a fifteenth embodiment of the present invention;

FIG. 41 is a side sectional view showing a laminated inductor according to a sixteenth embodiment of the present invention;

FIG. 42 describes how a gap is formed in a chip according to the sixteenth embodiment of the present invention;

FIG. 43 is a side sectional view showing a laminated inductor according to a seventeenth embodiment of the present invention;

FIG. 44 describes how the gap in the chip is impregnated with a synthetic resin according to the seventeenth embodiment of the present invention.

DETAILED DESCRIPTION OF THE PREFERRED EMBODIMENTS

The present invention is described in detail with reference to the accompanying drawings.

FIG. 1 is a perspective view showing a laminated inductor 10 according to a first embodiment of the present invention, and FIG. 10 is an exploded perspective view showing the laminated structure of the laminated inductor 10. In the figures, 11 is a rectangular parallelepiped chip of a magnetic or non-magnetic insulating material having a laminated structure, 12 is a coil consisting of internal conductors buried in the chip 11 and spirally connected together, and 13*a* and 13*b* are a pair of terminal electrodes provided at the respective ends of the chip 11 in the lamination direction of the laminated structure.

The coil 12 is formed in such a way that its winding center line (Y) is located on a straight line joining the centers of the end surfaces of the chip 11 forming the terminal electrodes 13*a* and 13*b*. The respective ends of the coil 12 are connected to the terminal electrodes 13*a* and 13*b* via leadout conductors 14*a* and 14*b* located on the winding center line (Y) of the coil 12.

The chip 11 is formed by laminating one or more layers of a top-layer sheet 41 consisting of an rectangular insulating material sheet of a predetermined thickness; connection sheets 42 and 47; coil-layer sheets 43 to 46; and a bottom-layer sheet 48 as shown in FIG. 10.

In the following description, the lamination direction of the sheets 41 to 48 is defined as the vertical direction so as to correspond to FIG. 10.

The coil 12 is formed by laminating a plurality of rectangular coil-layer sheets 43 to 46 having in their top surface approximately-U-shaped internal coil conductors (Pb1) to (Pb4), respectively, having at one end the via hole (h) with a conductor filled therein. When the coil-layer sheets 43 to 46 are laminated, the via-hole end of each of the internal coil-conductors (Pb1) to (Pb4) is connected via the conductor in the via hole (h) to the other end of another internal coil conductor immediately above or below the first conductor so that the internal coil conductors (Pb1) to (Pb4) formed in the plurality of layers form the spiral coil 12.

In addition, the coil 12 is formed in such a way that the winding locus of the coil as seen in the direction of the winding center line (Y) is point-symmetrical around the central point through which the winding center line (Y) passes.

In the following description, the via hole with a conductor filled therein is simply referred to as a "via hole", and "connected to the via hole" and "connected via the via hole"mean "connected to the conductor filled in the via hole" and "connected via the conductor filled in the via hole".

In addition, a connection sheet 42 having in its surface a connection conductor (Pa1) with the via hole (h) formed at one end is laminated on the coil-layer sheet 43, and this via hole (h) connects the connection conductor (Pa1) and the internal coil conductor (Pb1) together.

Furthermore, one or more top-layer sheets 41 with the leadout conductor (Pa) formed in the via hole (h) located at the center are laminated on the connection sheet 42, and during lamination, the leadout conductor (Pa) is connected to the other end of the connection conductor (Pa1).

In addition, a connection sheet 47 having in its surface a connection conductor (Pc1) with the via hole (h) formed at one end is laminated under the coil-layer sheet 46, and the other end of the connection conductor (Pc1) and the internal coil conductor (Pb4) are connected together via the via hole (h) formed in the coil-layer sheet 46 located over the connection conductor (Pc1).

Furthermore, one or more bottom-layer sheets 48 with the leadout conductor (Pc) formed in the via hole (h) located at the center are laminated under the connection sheet 47, and during lamination, the leadout conductor (Pc) is connected to one end of the connection conductor (Pc1).

Thus, the plurality of leadout conductors (Pa) form the leadout conductor 14*a,* and the plurality of leadout conductors (Pc) form the leadout conductor 14*b*.

Next, a method for fabricating this laminated inductor is described.

Before fabrication, the sheets 41 to 48 are prepared.

The coil-layer sheets 43 to 46 are formed by forming a via hole (h) at a predetermined position of each insulating green sheet mainly consisting of a BaO or $TiO_2$ ceramic material and then forming four types of U-shaped internal coil conductors (Pb1) to (Pb4) in the respective sheets in such a way that their ends overlap the via hole (h). In addition to the U shape, the internal coil conductors (Pb1) to (Pb4) may have a non-annular shape such as an L shape, as is well known.

The top- and bottom-layer sheets 41 and 48 are produced by forming the via hole (h) at the center of each of similar insulating green sheets, that is, at the position of the winding center line of the coil 12 and then forming the rectangular leadout conductors (Pa) and (Pc) in the sheets in such a way as to overlap the via hole (h).

The connection sheets 42 and 47 are produced by forming the via hole (h) at a predetermined position of each of similar insulating sheets and then forming the connection conductors (Pa1) and (Pc1) in such a way as to overlap both the internal coil conductors (Pb1) to (Pb4) and the leadout conductors (Pa) and (Pc), respectively.

The via hole (h) is formed by means of the irradiation of laser beams if the insulating green sheet is supported by a film. Alternatively, the via hole (h) is formed by means of die punching if the insulating green sheet is not supported by a film.

Then, the film (if any) is peeled off from each of the prepared sheets 41 to 48, which are then laminated in the above order and compressed at a pressure about 500 kg/cm$^2$ to form a sheet laminated body. The number of the top- and bottom-layer sheets 41 and 48 used corresponds to the layer thickness, and the number of the coil-layer sheets 43 to 46 used corresponds to the number of coil windings.

Then, the sheet laminated body is baked at about 900° C. A method such as dipping is then used to apply a conductor paste to both lamination-wise ends of the chip 11 obtained by means of baking, and the paint is baked to form the terminal electrodes 13*a* and 13*b,* thereby obtaining the laminated inductor 10. Then, the terminal electrodes 13*a* and 13*b* may be Sn—pb plated as required.

In the laminated inductor 10, the chip 11 is shaped like a rectangular-parallelepiped, the winding center line (Y) of the coil 12 is set on a straight line joining the centers of the end surfaces of the chip where the terminal electrodes 13*a* and 13*b* are formed, and the leadout conductors 14*a* and 14*b* are located on the winding center line (Y). Thus, when the laminated inductor 10 is mounted on the circuit board in such a way that the surface of the circuit board is opposed to the top or bottom surface of the chip 11 in FIG. 1, the distances (the locational relationship) between the coil 12 and the circuit board and between the leadout conductors 14*a* and 14*b* and the circuit board remains unchanged in either case. Thus, the magnetic resistance to magnetic fluxes generated around the coil 12 and leadout conductors 14*a* and 14*b* is almost the same in each mounting orientation, thereby preventing the inductance from being changed.

In addition, when the laminated inductor 10 is mounted on the circuit board whichever of the four surfaces of the chip 11 different from its end surfaces in FIG. 1 is opposed to the surface of the circuit board, even if the chip 11 is vertically reversed in mounting on the circuit board, the distances (the locational relationship) between the coil 12 and the circuit board and between the leadout conductors 14*a* and 14*b* and the circuit board remain unchanged. Thus, the magnetic resistance to magnetic fluxes generated around the coil 12 and leadout conductors 14*a* and 14*b* is almost the same in each mounting orientation, thereby preventing the inductance from being changed.

Next, a second embodiment of the present invention is described.

FIG. 11 is a perspective view showing a laminated inductor according to a second embodiment of the present invention, and FIG. 12 is an exploded perspective view showing the laminated structure of the laminated inductor. In the figures, the same components as in the first embodiment has the same reference numerals, and their description is omitted.

In addition, the second embodiment differs from the first embodiment in that the two leadout conductors are not located on the winding center line (Y) of the coil but symmetrically around the winding center line (Y).

That is, in a laminated inductor 50 in the second embodiment, leadout conductors 51*a*, 51*b* and 52*a*, 52*b* are formed at the respective ends of a chip 11 in such a manner that their ends are exposed on one of the diagonal lines in the end surface of the chip and at an equal distance from the central point through which the winding center line (Y) passes and that the conductors are parallel with the winding center line (Y), is as shown in FIG. 11.

The leadout conductors 51*a*, 51*b*, 52*a*, and 52*b* can each be obtained by forming the via hole (h) and the leadout conductors (Pa) and (Pc) in the top- and bottom-layer sheets 41 and 48, as in the leadout conductors 14*a* and 14*b* in the first embodiment.

In addition, connection conductors (Pd1) and (Pd2) shaped to connect the ends of the coil 12 to the leadout conductors 51*a*, 51*b*, 52*a*, and 52*b* are formed in connection sheets 42 and 47.

The laminated inductor 50 according to the second embodiment can provide effects similar to those of the first embodiment.

That is, in the laminated inductor 50 in the second embodiment, the winding center line (Y) of the coil 12 is set in the direction of a line joining centers of the end surfaces of the chip together, the coil 12 is formed in such a way that the winding locus of the coil 12 as seen in the direction of the winding center line is point-symmetrical around the central point through which the winding center line (Y) passes, and the two leadout conductors 51*a* and 51*b* or 52*a* and 52*b* joining the end of the coil and the terminal electrode 13*a* and 13*b* together are located symmetrically around the winding center line (Y) of the coil 12. Thus, if the inductor is vertically reversed when mounted on the circuit board, the distances between the coil 12 and the circuit board and between the leadout conductors 51*a* and 51*b* or 52*a* and 52*b* remain unchanged. Thus, the magnetic resistance remains the same in each mounting orientation, thereby preventing the inductance provided by the coil 12 and leadout conductors 51*a*, 51*b*, 52*a*, and 52*b* from being changed by the mounting orientation.

Although the second embodiment forms the leadout conductors 51*a*, 51*b* and 52*a*, 52*b* on the diagonal line on the respective end surface of the chip 11, the present invention is not limited to this aspect. The above effects can be obtained as long as the leadout conductors are formed symmetrically around the winding center line (Y) of the coil 12, and the positions at which the conductors are formed and the number of them may be determined as required.

In addition, although the first and second embodiments form the coil 12 in such a way that the winding locus of the coil 12 as seen in the direction of the winding center line (Y) of the coil 12 is rectangular, the present invention is not limited to this aspect. Similar effects can be obtained by forming the coil 12 in such a way that the winding locus of the coil as seen in the direction of the winding center line (Y) is point-symmetrical around the central point through which the winding center line (Y) passes. For example, the winding locus (Loc) of the coil 12 as seen in the direction of the winding center line (Y) must only be point-symmetrical around the central point (Yp) through which the winding center line (Y) passes, as shown in FIGS. 13*a* to 13*f*, and similar effects can be obtained even if the winding locus (Loc) is a slightly tilted rectangle, a square, a circle, an ellipse, or a lightly tilted ellipse.

Next, a third embodiment of the present invention is described.

FIG. 14 is a perspective view of a laminated inductor 60 according to a third embodiment, and FIG. 15 shows the winding locus of a coil as seen in the direction of the winding center line of the coil.

In the figures, 61 is a rectangular-parallelepiped chip of a magnetic or non-magnetic insulating material having a laminated structure, 62 is a coil consisting of internal conductors buried in the chip 61 and spirally connected together, and 63*a* and 63*b* are a pair of terminal electrodes provided at the respective longitudinal ends of the chip 61, that is, the respective ends in the lamination direction of the laminated structure. In addition, 64*a* and 64*b* are leadout conductors that connect both ends of the coil 62 to the terminal electrodes 63*a* and 63*b*, respectively.

The winding center line (Y) of the coil 62 is set on a straight line joining the centers of the end surfaces of the chip 61, and the leadout conductors 64*a* and 64*b* are located on the winding center line (Y).

The third embodiment is configured in almost the same manner as the laminated inductor 10 in the first embodiment and differs from it in that the coil 62 is formed in such a manner that the winding locus (Loc) of the coil 62 is parallel with one of the four sides (the bottom surface in FIG. 14) of the chip 61 different from its end surfaces and that the locus (Loc) is symmetrical around a straight line (X) orthogonal to the winding center line (Y) of the coil 62.

That is, the winding locus (Loc) of the coil 62 shown in FIG. 15 constitutes an isosceles triangle having as a vertical bisector the straight line (X) passing through the central point (Yp).

In the laminated inductor 60 of this configuration, the winding center line (Y) of the coil 62 is set on the straight line joining the centers of the end surfaces of the chip on which the terminal electrodes 63*a* and 63*b* are formed. In addition, the coil 62 is formed in such a manner that the winding locus (Loc) of the coil 62 as seen in the direction of the winding center line (Y) is parallel with one of the sides of the chip different from its end surfaces and that the locus (Loc) is symmetrical around the straight line (X) orthogonal to the winding center line (Y). Moreover, the leadout conductors 64*a* and 64*b* joining the respective ends of the coil 62 and the terminal electrodes 63*a* and 63*b* are located on the winding center line (Y) of the coil 62. Thus, when the laminated inductor 60 is mounted on the circuit board (Z), the distances between the coil 62 and the circuit board (Z) and between the leadout conductors 64*a* and 64*b* and the circuit board (Z) remain unchanged whichever of the front and rear surfaces of the chip that are the two sides (the top and bottom surfaces in FIG. 14) parallel with the straight line (X) orthogonal to the winding center line (Y) is opposed to the surface of the circuit board (Z). Accordingly, the magnetic resistance remains the same in each mounting orientation, thereby preventing the inductance provided by the coil 62 and leadout conductors 64*a* and 64*b* form being changed by the mounting orientation.

Next, a fourth embodiment of the present invention is described.

FIG. 16 is a perspective view showing a laminated inductor according to a fourth embodiment of the present invention. In the figures, the same components as in the third embodiment has the same reference numerals, and their description is omitted.

In addition, the fourth embodiment differs from the third embodiment in that the two leadout conductors are not located on the winding center line (Y) of the coil 62 but symmetrically around the winding center line (Y).

That is, in a laminated inductor 60' in the fourth embodiment, leadout conductors 65*a,* 65*b* and 66*a,* 66*b* are formed at the respective ends of a chip 61 in such a manner that their ends are exposed on one of the diagonal lines in the end surface of the chip 61 and at an equal distance from the central point through which the winding center line (Y) passes and that the conductors are parallel with the winding center line (Y), is as shown in FIG. 16.

The leadout conductor 65*a,* 65*b,* 66*a,* and 66*b* can be obtained by forming the via hole (h) and the leadout conductors (Pa) and (Pc) in the top- and bottom-layer sheets 41 and 48, as described above.

In addition, of course, connection conductors shaped to connect the ends of the coil 62 to the leadout conductors 65*a,* 65*b,* 66*a,* and 66*b* are formed in connection sheets 42 and 47.

The laminated inductor 60' according to the fourth embodiment can provide effects similar to those of the third embodiment.

That is, in the laminated inductor 60', the winding center line (Y) of the coil 62 is set on a straight line joining the centers of the end surfaces of the chip where terminal electrodes 63*a* and 63*b* are formed. In addition, the coil 62 is formed in such a manner that the winding locus (Loc) of the coil 62 is parallel with one of the sides of the chip 61 different from its end surfaces and that the locus is symmetrical around a straight line orthogonal to the winding center line (Y) of the coil 62. Furthermore, the two leadout conductors 65*a* and 65*b* or 66*a* and 66*b* joining the end of the coil and the terminal electrode 63*a* or 63*b* together are located symmetrically around the winding center line (Y) of the coil 62. Thus, when the laminated inductor 60' is mounted on the circuit board, the distances between the coil 62 and the circuit board and between the leadout conductors 65*a,* 65*b,* 66*a,* and 66*b* and the circuit board remain unchanged whichever of the front and rear surfaces of the chip 61 that are the two sides parallel with the straight line orthogonal to the winding center line (Y) is opposed to the surface of the circuit board. Accordingly, the magnetic resistance remains the same in each mounting orientation, thereby preventing the inductance provided by the coil 62 and leadout conductors 65*a,* 65*b,* 66*a,* and 66*b* being changed by the mounting orientation.

Although the fourth embodiment forms the leadout conductors 65*a,* 65*b* and 66*a,* 66*b* on the diagonal line on the respective end surface of the chip 61, the present invention is not limited to this aspect. The above effects can be obtained as long as the leadout conductors are formed symmetrically around the winding center line (Y) of the coil 62, and the positions at which the conductors are formed and the number of them may be determined as required.

In addition, although the third and fourth embodiments form the coil 62 in such a way that the winding locus of the coil 62 as seen in the direction of the winding center line (Y) of the coil 62 is an isosceles triangle, the present invention is not limited to this aspect.

Similar effects can be obtained by forming the coil 62 in such a manner that the winding locus of the coil as seen in the direction of the winding center line (Y) is parallel with one of the sides of the chip 61 different from its end surfaces and that the locus is symmetrical around the straight line (X) orthogonal to the winding center line (Y).

Next, a fifth embodiment of the present invention is described.

FIG. 17 is a perspective view of a laminated inductor 70 according to a fifth embodiment, FIG. 18 shows the winding locus of a coil as seen in the direction of the winding center line of the coil, and FIG. 19 is an exploded perspective view showing the laminated structure of the inductor.

In these figures, 71 is a rectangular-parallelepiped-shaped chip of a magnetic or non-magnetic insulating material having a laminated structure, and 72 is a coil consisting of internal conductors buried in the chip 71 and spirally connected together. Reference numerals 73*a* and 73*b* designate a pair of terminal electrodes provided at the respective longitudinal ends of the chip 71, that is, the respective ends in the lamination direction of the laminated structure of the chip 71.

An end surface 71*a* of the chip 71 on which the terminal electrode 73*a* or 73*b* is formed constitutes a square. In addition, the coil 72 is formed in such a way that its winding center line Y is located on a straight line joining together the centers of the end surfaces 71*a* of the chip 71 forming the terminal electrodes 73 and 73*b* and that the winding locus of the coil 72 as seen in the direction of the winding center line (Y) is line-symmetrical around each of the two diagonal lines of the end surface 71*a* of the chip 71. Furthermore, the respective ends of the coil 72 are connected to the terminal electrodes 73*a* and 73*b* via leadout conductors 74*a* and 74*b* located on the winding center line (Y) of the coil 72.

The coil 72 is formed by laminating a plurality of square coil-layer sheets 83 to 86 having in their top surface U-shaped internal coil conductors (Pe1) to (Pe4), respectively, having at one end the via hole (h) with a conductor filled therein. When the coil-layer sheets 83 to 86 are laminated, the via-hole end of each of the internal coil-conductors (Pe1) to (Pe4) is connected via the conductor in the via hole (h) to the other end of another internal coil conductor immediately above or below the first conductor so that the internal coil conductors (Pe1) to (Pe4) formed in the plurality of layers form the spiral coil 72.

In addition, according to the fifth embodiment, the coil 72 is formed in such a manner that the winding locus of the coil 72 as seen in the direction of the winding center line (Y) of the coil 72 constitutes a square having diagonal lines overlapping the two corresponding diagonal lines in the end surface 71*a* of the chip 71.

A square connection sheet 82 having in its surface a connection conductor (Pf1) with the via hole (h) formed therein is laminated on the coil-layer sheet 83, and this via hole (h) connects the connection conductor (Pf1) and the internal coil conductor (Pe1) together.

Furthermore, one or more square top-layer sheets 81 with the leadout conductor (Pa) formed in the via hole (h) located as described above are laminated on the connection sheet 82, and during lamination, the leadout conductor (Pa) is connected to the connection conductor (Pf1).

In addition, a connection sheet 87 having in its surface a square connection conductor (Pf2) with the via hole (h) formed therein is laminated under the coil-layer sheet 86, and the connection conductor (Pf2) and the internal coil conductor (Pe4) are connected together via the via hole (h) formed in the coil-layer sheet 86 located over the conductor (Pf2).

Furthermore, one or more square bottom-layer sheets 88 with the leadout conductor (Pc) formed in the via hole (h) located as described above are laminated under the connection sheet 87, and during lamination, the leadout conductor (Pc) is connected to the connection conductor (Pf2).

Thus, the plurality of leadout conductors (Pa) for the leadout conductor 74*a,* and the plurality of leadout conductors (Pc) form the leadout conductor 74*b*.

In the laminated inductor 70 of the above configuration, the coil 72 is formed in such a way that the cross section of the chip perpendicular to the winding center line (Y) of the coil 72 is a square and that the winding locus of the coil 72 as seen in the direction of the winding center line (Y) is line-symmetrical around each of the two diagonal lines of the end surface of the chip 71. Thus, when the chip 71 is mounted on the circuit board, the distances (the locational relationship) between the coil 72 and the circuit board and between the leadout conductors 74*a* and 74*b* and the circuit board remain unchanged whichever of the top and bottom surfaces and sides of the chip 71 is opposed to the surface of the circuit board. Accordingly, the magnetic resistance and inductance of the laminated inductor 70 remains the same whichever mounting orientation is selected.

Next, a sixth embodiment of the present invention is described.

FIG. 20 is a perspective view showing a laminated inductor according to the sixth embodiment of the present invention, and FIG. 21 shows positions at which leadout conductors are formed. In the figures, the same components as in the fifth embodiment has the same reference numerals, and their description is omitted.

In addition, the sixth embodiment differs form the fifth embodiment in that the two leadout conductors are not located on the winding center line (Y) of the coil 72 but are located at the respective ends of the chip 71 on the diagonal line in the end surface thereof and symmetrically around the winding center line (Y) of the coil 72.

That is, in a laminated inductor 70' in the sixth embodiment, leadout conductors 75*a*, 75*b* and 75*c*, 75*d* are formed at the respective ends of a chip 71 such a manner that their ends are exposed on one of the diagonal lines in the end surface of the chip 71 and at an equal distance (D) from the central point (Yp) through which the winding center line (Y) passes and that the conductors are parallel with the winding center line (Y), as shown in the figure.

The leadout conductors 75*a*, 75*b*, 75*c*, and 75*d* can each be obtained by forming the via hole (h) and the leadout conductors in the top- and bottom-layer sheets 81 and 88, as in the leadout conductors 74*a* and 74*b* in the fifth embodiment.

In addition, connection conductors shaped to connect the ends of the coil 72 to the leadout conductors 75*a*, 75*b*, 75*c*, and 75*d* are formed in the connection sheets 82 and 87.

The laminated inductor 70' according to the sixth embodiment can provide effects similar to those of the fifth embodiment.

In the laminated inductor 70' of the above configuration, the coil 72 is formed in such a way that the cross section of the chip perpendicular to the winding center line (Y) of the coil 72 is a square and that the winding locus of the coil 72 as seen in the direction of the winding center line is line-symmetrical around each of any two crossing straight lines perpendicularly crossing the winding center line (Y) of the coil 72. Furthermore, at least two of the leadout conductors 75*a* and 75*d* are located on the diagonal line in the cross section of the chip and symmetrically around the winding center line of the coil 72. Thus, even if multiple mounting orientations are possible in which the inductor is mounted on the circuit board, the distances between the coil 72 and the circuit board and between the leadout conductors 75*a* to 75*d* and the circuit board are always the same. Consequently, the distances between the coil 72 and the circuit board and between the leadout conductors 75*a* to 75*d* and the circuit board remain unchanged regardless of the multiple mounting orientations, that is, whichever of the four sides of the chip different from the end surfaces is opposed to the surface of the circuit board. Accordingly, the magnetic resistance remains the same in each mounting orientation, thereby preventing the inductance provided by the coil 72 and leadout conductors 75*a* to 75*d* from being changed by the mounting orientation.

Next, a seventh embodiment of the present invention is described.

FIG. 22 is a perspective view showing a laminated inductor 70" according to the seventh embodiment of the present invention, and FIG. 23 shows positions at which leadout conductors are formed. In the figures, the same components as in the fifth embodiment has the same reference numerals, and their description is omitted.

In addition, the seventh embodiment differs from the fifth embodiment in that the leadout conductors are not located on the winding center line (Y) of the coil 72 but at the respective ends of the chip at four different positions that are 90°-rotation-symmetrical about the winding center line of the coil 72.

That is, in a laminated inductor 70" in the seventh embodiment, leadout conductors 76*a* to 76*a* and 76*e* to 76*h* are formed at the respective ends of a chip 71 in such a manner that their ends are exposed on any two crossing straight lines (X1) and (X2) crossing the winding center line (Y) in the end surface of the chip and at an equal distance (D) from the central point (Yp) through which the winding center line (Y) passes and that the conductors are parallel with the winding center line (Y), as shown in the figure.

The conductors 76*a* and 76*h* can each be obtained by forming the via hole and the leadout conductors in the top- and bottom-layer sheets 81 and 88, as in the leadout conductors 74*a* and 74*b* in the fifth embodiment.

In addition, connection conductors shaped to connect the ends of the coil 72 to the leadout conductors 76*a* to 76*h* are formed in connection sheets 82 and 87.

The laminated inductor 70" according to the seventh embodiment can provide effects similar to those of the fifth embodiment.

Although the fifth to seventh embodiments form the coil 72 in such a way that the winding locus (Loc) of the coil 72 as seen in the direction of the winding center line (Y) of the coil 72 is a square having diagonal lines overlapping the two corresponding diagonal lines in the end surface 71*a* of the chip 71, the present invention is not limited to this aspect. Similar effects can be obtained by forming the coil 72 in such a manner that the winding locus of the coil 72 as seen in the direction of the winding center line (Y) is parallel with the cross section of the chip and that the locus is also line-symmetrical about each of any two crossing straight lines crossing the winding center line (Y) of the coil 72.

Next, an eighth embodiment of the present invention is described.

FIG. 24 is a perspective view of a laminated inductor 90 according to the eighth embodiment, FIG. 25 shows the winding locus of a coil as seen in the direction of the winding center line of the coil, and FIG. 26 is an exploded perspective view showing the laminated structure of the inductor.

In these figures, 91 is a cylindrical chip of a magnetic or non-magnetic insulating material having a laminated structure, and 92 is a coil consisting of internal conductors buried in the chip 91 and spirally connected together. Reference numerals 93*a* and 93*b* designate a pair of terminal electrodes provided at the respective longitudinal ends of the chip 91, that is, the respective ends in the lamination direction of the laminated structure of the chip.

The end surface 91*a* of the chip on which the terminal electrode 93*a* or 93*b* is formed is circular, and the coil 92 is formed in such a way that its winding center line (Y) is located on a straight line joining together the centers of the end surfaces 91*a* of the chip forming the terminal electrodes 93*a* and 93*b* and that the winding locus (Loc) of the coil as seen in the direction of the winding center line (Y) constitutes in any cross section of the chip a circle having as its center the central point (Yp) through which the winding center line (Y) passes. That is, the coil 92 is formed in such a manner that the winding locus (Loc) as seen in the direction of the winding center line (Y) of the coil 92 is located at an equal distance from the winding center line (Y).

Moreover, the respective ends of the coil 92 are connected to the terminal electrodes 93*a* and 93*b* via leadout conductors 94*a* and 94*b* located on the winding center line (Y) of the coil 92.

The coil 92 is formed by laminating a plurality of circular coil-layer sheets 103 and 104 having in their top surface circular internal coil conductors (Pg1) and (Pg2), respectively, having at one end the via hole (h) with a conductor filled therein. When the coil-layer sheets 103 and 104 are laminated, the via-hole end of the internal coil-conductor (Pg1) or (Pg2) is connected via the conductor in the via hole (h) to the other end of the other internal coil conductor over the first conductor so that the internal coil conductors (Pg1) and (Pg2) formed in the plurality of layers form the spiral coil 92.

A circular connection sheet 102 having in its surface a connection conductor (Ph1) with the via hole (h) formed therein is laminated on the coil-layer sheet 103, and this via hole (h) connects the connection conductor (Ph1) and the internal coil conductor (Ph1) together.

Furthermore, one or more circular top-layer sheets 101 with the leadout conductor (Pa) formed in the via hole (h) located at the center are laminated on the connection sheet 102, and during lamination, the leadout conductor (Pa) is connected to the connection conductor (Ph1).

In addition, a connection sheet 105 having in its surface a circular connection conductor (Ph2) with the via hole (h) formed therein is laminated under the coil-layer sheet 104, and the connection conductor (Ph2) and the internal coil conductor (Pg2) are connected together via the via hole (h) formed in the coil-layer sheet 104 located over the conductor (Ph2).

Furthermore, one or more circular bottom-layer sheets 106 with the leadout conductor (Pc) formed in the via hole (h) located at the center are laminated under the connection sheet 105, and during lamination, the leadout conductor (Pc) is connected to the connection conductor (Ph2).

Thus, the plurality of leadout conductors (pa) form the leadout conductor 94*a,* and the plurality of leadout conductors (Pc) form the leadout conductor 94*b.*

According to the laminated inductor 90 consisting of the above configuration, the winding center line (Y) of the coil 92 is formed in the direction of a line joining the centers of the end surfaces 91*a* of the chip where the terminal electrodes 93*a* and 93*b* are formed, the coil 92 is formed in such a way that the distance between the winding locus (Loc) of the coil 92 as seen in the direction of the winding center line (Y) and the central point through which the winding center line (Y) passes remains constant, and the leadout conductors 94*a* and 94*b* connecting the coil 92 to the terminal electrodes 93*a* and 93*b* are located on the winding center line (Y) of the coil 92. Consequently, when the inductor is mounted on the circuit board, the distances between the coil 92 and the circuit board and between the leadout conductors 94*a* and 94*b* and the circuit board remain unchanged regardless of the manner in which it is mounted as long as the winding center line (Y) of the coil is parallel with the surface of the circuit board. As a result, the magnetic resistance remains the same in each mounting orientation, thereby preventing the inductance provided by the coil 92 and leadout conductors 94*a* and 94*b* from being changed by the mounting orientation.

Next, a ninth embodiment of this invention is described.

FIG. 27 is a perspective view showing a laminated inductor 110 in the ninth embodiment, FIG. 28 is a side sectional view of FIG. 27, FIG. 29 is an exploded perspective view showing the laminated structure of FIG. 27, and FIG. 30 shows the arrangement of a leadout conductor as seen in the direction of the winding center line of the coil. In the figures, the same components as in the first embodiment have the same reference numerals and their description is omitted. The ninth embodiment differs from the first embodiment in that both ends of a coil 112 are set symmetrical around the center of the chip 11 and in that leadout conductors connecting the respective ends of the coil 112 to terminal electrodes 13*a* and 13*b* are also formed symmetrically around the center of the chip 11.

That is, in the ninth embodiment, the respective ends of the coil 112 are located on the winding locus of the coil as seen in the direction of the winding center line (Y) and symmetrically around the center of the chip 11.

In addition, the leadout conductors connecting the respective ends of the coil 112 to the terminal electrodes 13*a* and 13*b* are composed of first leadout conductors 114*a* and 114*b*, first connection conductors 115*a* and 115*b*, and connection conductors (second connection conductors) 116*a* and 116*b*.

The first leadout conductors 114*a* and 114*b* are located on the winding center line (Y). One end of each of the first leadout conductors 114*a* and 114*b* is connected to the connection conductor 116*a* and 116*b*, while the other end is exposed from the end surface of the chip 11 and connected to the terminal electrode 13*a* and 13*b*.

The first connection conductors 115*a* and 115*b* are located parallel with the winding center line (Y). One end of each of the first connection conductors 115*a* and 115*b* is connected to the end of the coil 112, while the other end is connected to the connection conductor 116*a* or 116*b*.

The connection conductors 116*a* and 116*b* are each L-shaped and are perpendicular to the winding center line (Y) of the coil 112. In addition, the connection conductors 116*a* and 116*b* are located symmetrically around the central point of the chip 11.

As shown in FIG. 29, the chip 11 is formed by laminating one or more layers of a first to a third upper-layer sheets 121A to 121C, coil layer sheets 122 to 126, and a first to a third-lower layer sheets 127A to 127C, wherein each sheet consists of a rectangular insulating material sheet of a predetermined thickness.

In the following description, the laminating direction of the sheets of the sheets 121 to 127 is assumed to be the vertical direction so as to correspond to FIG. 29.

The coil 112 is formed by laminating a plurality of rectangular coil layer sheets 122 to 126 having formed thereon approximately U-shaped internal coil conductors Pj1 to Pj5 each having a via hole (h) with a conductor filled therein at one end. When the coil layer sheets 122 to 126 are laminated, one end of each internal coil conductor Pj1 to Pj5 is connected to the other end of the vertically adjacent one through the conductors in the via hole (h) so that the internal coil conductors Pj1 to Pj5 formed in multiple layers form the spiral coil 112.

In addition, the coil 112 is formed is formed in such a way that the winding locus of the coil as seen in the direction of the winding center line (Y) is point-symmetrical around the central point through which the winding center line (Y) passes.

In addition, one or more layers of the third upper-layer sheets 121C each having a connection conductor Pk1 formed in the via hole (h) are laminated on the coil layer sheet 122, and during lamination, the connection conductor Pk1 is connected to the internal coil conductor Pj1 and the connection conductor 116*a*.

In addition, the second upper-layer sheet 121B having in its surface a connection conductor 116*a* having the via hole (h) formed at one end is laminated on the third upper-layer sheet 121C. These via holes (h) connect the second upper-layer sheet 121B to the connection conductor Pk1 of the third upper-layer sheet 121C.

Furthermore, one or more first upper-layer sheets 121A each having a leadout conductor Pk2 in the central via hole (h) are formed on a second upper-layer sheet 121B, and during lamination, the leadout conductor Pk2 is connected to the other end of the connection conductor 116*a*.

In addition, one or more layers of the first lower-layer sheets 127A each having a connection conductor Pl1 formed in the via hole (h) are laminated under the coil layer sheet 126, and during lamination, the connection conductor Pl1 is connected to the internal coil conductor Pj5 and the connection conductor 116*b*.

In addition, the second lower-layer sheet 127B having in its surface a connection conductor 116*b* having the via hole (h) formed at one end is laminated under the first lower-layer sheet 127A, and the via hole (h) formed in the first lower-layer sheet 127A located over the second lower-layer sheet 127B connects the second lower-layer sheet 127B to the connection conductor Pl1.

Furthermore, one or more third lower-layer sheets 127C each having a leadout conductor Pl2 in the central via hole (h) are formed under the second lower-layer sheet 127B, and during lamination, the leadout conductor Pl2 is connected to the other end of the connection conductor 116*b*.

Thus, the plurality of leadout conductors Pk1 form a one-end-side first leadout conductor 115*a*, while the plurality of leadout conductors Pl1 form the other-end-side first leadout conductor 115*b*. In addition, the plurality of leadout conductors Pk2 form a one-end-side first leadout conductor 114*a*, while the plurality of leadout conductors Pl2 form the other-end-side first leadout conductor 114*b*. Furthermore, the respective ends of the coil 112 are located on the winding locus of the coil as seen in the direction of the winding center line (Y) and symmetrically around the center of the chip 11.

The connection conductors 116*a* and 116*b* constitute a second connection conductor. In addition, a second leadout conductor is composed of the first connection conductors 115*a* and 115*b* and the connection conductors (second connection conductors) 116*a* and 116*b*.

In the above laminated inductor 110, the chip 11 is rectangular parallelopiped, the winding center line (Y) of the coil 112 is set on the straight line joining together the centers of the end surfaces of chip on which the terminal electrodes 13*a* and 13*b* are formed, respectively, and both ends of the coil 112 are set symmetrical around the center of the chip 11. Furthermore, the first leadout conductors 114*a* and 114*b*, first connection conductors 115*a* and 115*b*, and connection conductors (second connection conductors) 116*a* and 116*b* which all connect the respective end of the coil 112 to the terminal electrodes 13*a* and 13*b*, are located symmetrically around the center of the chip 11. Thus, when the laminated inductor 110 is mounted on the circuit board in such a way that the top or bottom surface of the chip 11 in FIG. 27 is opposed to the surface of the circuit board, the positional relationship between the circuit board and the coil 112, first leadout conductors 114*a* and 114*b*, first connection conductors 115*a* and 115*b*, and connection conductors (second connection conductors) 116*a* and 116*b* remains unchanged in the entire chip whichever surface of the chip is opposed to the circuit board. That is, the positional relationship between the coil 112 and the circuit board remains the same even if the inverted laminated inductor 110 is mounted on the circuit board. The positional relationship between the circuit board and the first leadout conductor 114*a*, first connection conductor 115*a*, and connection conductor (second connection conductor) 116*a* all on one side of the coil 112 and the positional relationship between the circuit board and the first leadout conductor 114*b*, first connection conductor 115*b*, and connection conductor (second connection conductor) 116*b* all on the other side are inverted when the vertically inverted laminated inductor 110 is mounted on the circuit board. In the entire laminated inductor 110, however, the general positional relationship can be assumed to remain unchanged.

Thus, almost uniform magnetic resistance is effected on magnetic fluxes generated around the coil 112, first leadout conductors 114*a* and 114*b,* first connection conductors 115*a* and 115*b,* and connection conductors (second connection conductors) 116*a* and 116*b,* thereby preventing the inductance from varying.

In addition, if the laminated inductor 110 is mounted on the circuit board in such a way that one of the sides of the chip 11 in FIG. 27 other than its end surfaces is opposed to the surface of the circuit board, the general positional relationship between the circuit board and the coil 112, first leadout conductors 114*a* and 114*b,* first connection conductors 115*a* and 115*b,* and connection conductors (second connection conductors) 116*a* and 116*b* remains unchanged whichever surface is opposed to the surface of the circuit board. Accordingly, almost uniform magnetic resistance is effected on magnetic fluxes generated around the coil 112, first leadout conductors 114*a* and 114*b,* first connection conductors 115*a* and 115*b,* and connection conductors (second connection conductors) 116*a* and 116*b,* thereby preventing the inductance from varying.

Furthermore, the connection conductors 116*a* and 116*b* may be L-shaped and located on the winding locus of the coil 112 to increase the inductance of the coil 112.

The positions and shapes of the first leadout conductors 114*a* and 114*b,* first connection conductors 115*a* and 115*b,* and connection conductors (second connection conductors) 116*a* and 116*b* are not limited to those described above, and similar effects can be obtained as long as these components are symmetrical about the center of the chip 11.

Similar effects can also be obtained even if the chip 11 is shaped like a regular square pole, that is, formed to have a square cross section perpendicular to the winding center line of the coil 112. In this case, each of the sheets 121 to 127 forming the chip 11 may be shaped like a square. Furthermore, by arranging the first connection conductors 115*a* and 115*b* on a diagonal line in a cross section of the coil 112 perpendicular to the winding center line and the connection conductors 116*a* and 116*b* on a diagonal line as shown in FIG. 31, similar effects can be obtained even if not only vertically inverted but also rotated inductor is mounted on the circuit board.

Next, a tenth embodiment of this invention is described.

FIG. 32 is a side sectional view showing a laminated inductor 131 according to the tenth embodiment. In this figure, the same components as in the ninth embodiment have the same reference numerals and their description is omitted. The tenth embodiment differs from the ninth embodiment in that the length L1 of the first connection conductors 115*a* and 115*b* is set larger than the length L2 of the first leadout conductors 114*a* and 114*b*.

This configuration allows the first leadout conductors 114*a* and 114*b* and the connection conductors 116*a* and 116*b* to be separated from the center of the magnetic fluxes generated by the coil 112. This can in turn reduce the loss of magnetic fields caused by the effect of the first leadout conductors 114*a* and 114*b* and connection conductors 116*a* and 116*b,* thereby increasing "Q" of the inductor.

By setting the length L2 of the first leadout conductors 114*a* and 114*b* smaller than the length L3 of the terminal electrodes 13*a* and 13*b* formed on surfaces of the chip 11 other than its end surfaces as shown in FIG. 33, the loss of magnetic fields caused by the effect of the first leadout conductors 114*a* and 114*b* and connection conductors 116*a* and 116*b* can be reduced.

Next, an eleventh embodiment of this invention is described.

FIG. 34 is a side sectional view showing a laminated inductor 132 according to the eleventh embodiment. In this figure, the same components as in the ninth embodiment have the same reference numerals and their description is omitted. The eleventh embodiment differs from the ninth embodiment in that the length L1 of the first connection conductors 115*a* and 115*b* is set smaller than the length L2 of the first leadout conductors 114*a* and 114*b*.

This configuration increases the gap between the first connection conductors 115*a* and 115*b* and the terminal electrodes 13*a* and 13*b* formed in a portion of the chip 11 other than its end surfaces to reduce the floating electrostatic capacity generated therebetween, thereby increasing the resonant frequency of the inductor. To increase this effect, the length L2 of the first leadout conductors 114*a* and 114*b* is preferably set larger than the length L3 of the terminal electrodes 13*a* and 13*b* formed in a surface of the chip 11 other than its end surfaces.

Next, a twelfth embodiment of this invention is described.

FIG. 35 is a side sectional view showing a laminated inductor 133 according to the twelfth embodiment. In this figure, the same components as in the ninth embodiment have the same reference numerals and their description is omitted. According to the twelfth embodiment, the length L2 of the first leadout conductors 114*a* and 114*b* is set the same as the length l3 of the terminal electrode formed in a surface of the chip 11 other than its end surfaces. By setting the length l2 of the first leadout conductors 114*a* and 114*b* in this manner, the floating electrostatic capacity can be prevented from occurring between the first connection conductors 115*a* and 115*b* and the terminal electrodes 13*a* and 13*b* while the loss of magnetic fields caused by the effect of the first leadout conductors 14*a* and 14*b* and connection conductors (second connection conductor) 116*a* and 116*b* can be reduced. This configuration is particularly effective when the number of windings of the coil 112 is small.

Next, a thirteenth embodiment of this invention is described.

FIG. 36 is an exploded perspective view showing the laminated structure of a laminated inductor 134 according to a thirteenth embodiment. In this figure, the same components as in the ninth embodiment have the same reference numerals and their description is omitted. The thirteenth embodiment differs from the ninth embodiment in that two coil conductors Pj1, two coil conductors Pj2, two coil conductors Pj3, two coil conductors Pj4, two coil conductors Pj5, and two coil conductors Pj6 forming the coil 112 are laminated so as to be connected in parallel, thereby reducing the electric resistance of the coil 112.

Next, a fourteenth embodiment of this invention is described.

FIG. 37 is a side sectional view showing a laminated inductor 135 according to a fourteenth embodiment. In this figure, the same components as in the ninth embodiment have the same reference numerals and their description is omitted. The fourteenth embodiment differs from the ninth embodiment in that the thickness of the first leadout conductors 114*a* and 114*b* is set larger than that of the first connection conductors 115*a* and 115*b*. That is, the diameter of the via holes (h) formed in the leadout conductors Pk2 and Pl2 forming the first leadout conductors 114*a* and 114*b* is set larger than that of the via holes (h) formed in the connection conductors Pk1 and Pl1 forming the first connection conductors 115*a* and 115*b*. This configuration increases the area of the exposed portion of the first leadout conductors 114*a* and 114*b* at the end surfaces of the chip 11 compared to the prior art, thereby improving the connectivity between the first leadout conductors 114*a* and 114*b* and the terminal electrodes 13*a* and 13*b*.

Next, a fifteenth embodiment of this invention is described.

FIG. 38 is a side sectional view showing a laminated inductor 136 according to a fifteenth embodiment, and FIG. 39 is its top sectional view. In these figures, the same components as in the ninth embodiment have the same reference numerals and their description is omitted. The fifteenth embodiment differs from the ninth embodiment in that the second connection conductor 117*a* and 117*b* connecting the first leadout conductors 114*a* and 114*b* and the first connection conductors 115*a* and 115*b* together are formed in such a way as to gradually approach the winding center line (Y) and first leadout conductors 114*a* and 114*b*. That is, as shown in FIG. 40, the second connection conductors 117*a* and 117*b* are formed by using the via holes (h) to couple the connection conductors Pk3 and Pl3 formed in the plurality of second upper-layer sheet insulating body layers in such a way as to be arranged like steps. This configuration allows the second connection conductors 117*a* and 117*b* to be arranged approximately in a line crossing the first leadout conductors at a larger angle (obtuse angle).

The following effects can be obtained by forming the second connection conductor 117*a* and 117*b* connecting the first connection conductors 115*a* and 115*b* and the first leadout conductors 114*a* and 114*b* together in such a way as to gradually approach the winding center line (Y) and first leadout conductors 114*a* and 114*b*. The second connection conductors 117*a* and 117*b* are formed so as to correspond to the gradual attenuation of the field strength, so the floating electrostatic capacity can be prevented from occurring between the second connection conductors and the terminal electrodes while reducing the loss of magnetic fields. This is particularly effective if the terminal electrodes 13*a* and 13*b* cover the coil 112 due to the compactification of electronic components or a large number of windings of the coil 112.

Next, a sixteenth embodiment of this invention is described.

FIG. 41 is a side sectional view showing a laminated inductor 137 according to a sixteenth embodiment. In this figure, the same components as in the ninth embodiment have the same reference numerals and their description is omitted. The sixteenth embodiment differs from the ninth embodiment in that a gap 141 is formed between the insulating bodies (magnetic substances) and internal conductors constituting the chip 11. The internal conductors constitute the coil 112, the first leadout conductors 114*a* and 114*b*, the first connection conductors 115*a* and 115*b*, and the connection conductors (second connection conductors) 116*a* and 116*b*.

If the gap 141 is formed between the magnetic substances and internal conductors constituting the chip 11 and even if the magnetic substances or internal conductors constituting the chip 11 are expanded or contracted due to external magnetic fields, the internal strain caused by the difference in contraction rate between the magnetic substances and the internal conductors does not occur, thereby reducing the variation of the inductance value caused by external fields to improve reliability.

This embodiment formed the gap 141 between the magnetic substances and internal conductors constituting the chip 11, in the following manner.

First, 49.0 mol % of $Fe_2O_3$, 35.0 mol % of NiO, 10.0 mol % of ZnO, and 6.0 mol % of CuO were each weighted, and these compounds were mixed with water using a ball mill to obtain a mixture.

Next, the mixture was dried and temporarily burned in the air at 800° C. for one hour to form an incompletely burned substance (ferrite). The incompletely burned substance was placed in the ball mill, where it is crushed for 15 hours while water is being added thereto. The slurry obtained was spray-dried using a spray dryer to obtain powders of the incompletely burned substance (ferrite powders). The specific surface area of the ferrite powders was 2.8 $m^2/g$.

Then, the ferrite powders and a binder mainly consisting of polyvinylbutyral were mixed in the ball mill to form a slurry.

Then, the slurry was defoamed using a deaerator and was coated on a polyester film using the doctor blade method. After drying, the film was cut into predetermined sizes and a through-hole is formed at a predetermined position of each piece to obtain magnetic substance sheets of thickness about 50 $\mu$m.

In addition, 70 wt. % of Ag powders (spherical grains, average grain size: 0.3 $\mu$m), 9 wt. % of ethylcellulose, 19 wt. % of butylcarbitol, and 2 wt. % of thickner were kneaded to produce Ag paste for internal conductor patterns.

Next, the conductor patterns consisting of the Ag paste were each printed on the incompletely burned magnetic substance sheet using the screen printing method.

Then, after the conductive patterns were dried, the magnetic substance sheets were laminated and pressurized at a pressure of 500 $kg/cm^2$ so as to be joined and integrated together. The sheets were then cut into dices to form a large number of laminate chips.

Then, the laminate chips were heated to burn and remove the binder, and were subsequently burned at 900° C. for one hours.

Then, the Ag paste is coated on one of the end surfaces of the laminate chip from which the terminal of the outermost conductor pattern was led out, and was burned in the air at 700° C. to form a large number of laminated inductors 137 each with a terminal electrode formed and connected to the terminal of the conductor pattern.

In this manufacturing method, the specific surface are of the magnetic substance powders that are a material of the magnetic substance sheets is preferably between 1.0 and 10.0 $m^2/g$, and the specific surface area of the conductive powders that are a material of the conductive patterns is preferably between 0.5 and 5.0 $m^2/g$.

The specific surface area of the magnetic substance powders should be between 1.0 and 10.0 $m^2/g$ because below 1.0 $m^2/g$, the magnetic substance powders cannot be sintered even if they are burned at 1,000° C. or lower and because beyond 10.0 $m^2/g$, a large amount of time and labor is required to manufacture powders to increase costs.

In addition, the specific surface area of the conductive powders should be 0.5 $m^2/g$ or more because if the specific surface area of the magnetic substance powders is 1.0 $m^2/g$ or more, contraction sufficient to form the gap 141 between the magnetic substance powders and the conductive powders cannot be obtained unless the specific surface area of the conductor powders is larger than or equal to this value.

The specific surface area of the conductive powders should be 5.0 $m^2/g$ or less because if the specific surface area of the magnetic substance powders is 10.0 $m^2/g$ or less, contraction sufficient to form the gap 141 between the magnetic substance powders and the conductive powders can be obtained if the specific surface are of the conductor powders is smaller than or equal to this value.

In addition, this manufacturing method enables the continuous gap to be formed almost uniformly in the magnetic substances constituting the chip 11, as shown in FIG. 42.

According to the above manufacturing method, of the large number of laminated inductors 137 each with the gap 141 formed between the magnetic substance bodies and internal conductors constituting the chip 11, several tens are sampled and impregnated with an epoxy resin by means of pressurization. The inductors are heated to thermally set the epoxy resin. The resin is then broken and its broken surface is observed to confirm the gap 141.

The method for forming the gap between the magnetic substances and internal conductors forming the chip 11 includes methods for changing the amounts of contraction of these materials, their specific surface areas, or their grain sizes, a method for containing in the magnetic substance sheet the decomposed resin that may otherwise be evaporated and disappear during burning, and a method for changing the burning conditions.

In addition, since the leadout conductor section connecting the coil 112 to the terminal electrodes 13*a* and 13*b*, in particular, the second leadout conductor consisting of the first connection conductors 115*a* and 115*b* and the connection conductors 116*a* and 116*b* is most likely to be broken due to the internal strain, the gap is preferably formed at least around the second leadout conductor.

Next, a seventeenth embodiment of this invention is described.

FIG. 43 is a side sectional view showing a laminated inductor 138 according to a seventeenth embodiment. In this figure, the same components as in the sixteenth embodiment have the same reference numerals and in their description is omitted. The seventeenth embodiment differs from the sixteenth embodiment in that a gap is formed between the magnetic substances and between the magnetic substances and internal conductors constituting the chip 11, followed by the impregnation of the gap with a synthetic resin 142, and in that the terminal electrodes 13*a* and 13*b* are formed of porous conductors so that the pores in the terminal electrodes 13*a* and 13*b* are impregnated with the synthetic resin. The internal conductors constitute the coil 112, the first leadout conductors 114*a* and 114*b*, the first connection conductors 115*a* and 115*b*, and the connection conductors (second connection conductors) 116*a* and 116*b*. The above synthetic resin may be silicone, epoxy, or phenol resin, but may be a different resin.

In the laminated inductor 137 manufactured using the manufacturing method described in the sixteenth embodiment, the gap is formed between the magnetic substances and internal conductors constituting the chip 11 and is also formed between the magnetic substances and inside the terminal electrodes 13*a* and 13*b* constituting the chip 11, as shown in FIG. 44. The following effects can be obtained by impregnating the gap with the synthetic resin. When the gap between the magnetic substances and internal conductors constituting the chip 11 is impregnated with the synthetic resin 142, the internal conductors, which have been partly floating in the chip 11 due to the gap, are fixed and precluded from vibrating despite an external impact or a rapidly varying electromagnetic force, thereby preventing the metal of the internal conductors from being fatigued, which improves reliability of the electronic components.

In addition, as shown in FIG. 44, when the gap 11 between the magnetic substances 143 constituting the chip 11 is impregnated with the synthetic resin 142, the binding strength of the chip 11 in the laminating direction is increased to restrain the chip 11 from being peeled off along the gap in order to improve reliability.

In addition, since the terminal electrodes 13*a* and 13*b* are formed of a porous material in which the internal gap consists of a continuous pore, the chip 11 can be impregnated with the synthetic resin through the terminal electrodes 13*a* and 13*b*. This configuration enables the gap in the chip 11 to be impregnated with the synthetic resin easily.

Moreover, since the terminal electrodes 13*a* and 13*b* are formed of a porous material in which the internal gap consists of a continuous pore, the synthetic resin contained in the terminal electrodes 13*a* and 13*b* continues with the synthetic resin contained in the chip 11 to improve the mechanical strength of the terminal electrodes 13*a* and 13*b* in binding with the chip 11.

To manufacture the laminated inductor 138, the laminated inductor 137 described in the sixteenth embodiment is formed first. At this point, the Ag paste for the terminal electrodes 13*a* and 13*b* has the following composition.

| | |
|---|---|
| Ag powders (spherical grains; average grain size: 0.5 $\mu$m) | 70 wt. % |
| Glass frit ($ZnO—B_2O_3—SiO_2$) | 4 wt. % |
| Etylcellulose | 9 wt. % |
| Mixture of butylcarbitolacetate and ethylcarbitol (1:1) | 13 wt. % |

The use of the Ag paste of the above composition makes the terminal electrodes 13*a* and 13*b* porous and allows the pores in the terminal electrodes 13*a* and 13*b* to connect the surfaces of the terminal electrodes 13*a* and 13*b* to the surface of the chip 11.

Subsequently, a silicone resin liquid, which as been diluted with toluene, is placed in a container, and the laminated inductor 137 with the gaps formed therein is placed in the silicone resin liquid. The container is then placed in a pressure-reduced container to reduce the pressure down to 30 Torr using a vacuum pump. The container is left as it is approximately for 10 minutes. This processing allows the gap between the magnetic substances and between the magnetic substances and internal conductors to be impregnated with the silicone resin.

Then, the laminated inductor is unloaded from the container and is heated at 200° C. for one hour to harden the silicone resin contained in the gap.

Next, the laminated inductor is placed in a rotary barrel to remove the silicone resin from the surfaces of the terminal electrodes 13*a* and 13*b*. The surface of the terminal electrodes 13*a* and 13*b* are electroplated to complete the laminated inductor 138.

The synthetic resin is generally susceptible to heat, so the synthetic resin cannot be applied until after the baking of the terminal electrodes 13*a* and 13*b*. Due to the terminal electrodes 13*a* and 13*b* formed of the porous conductive material, however, the above manufacturing method enables the entire chip 11 to be impregnated with the synthetic resin even after the terminals 13*a* and 13*b* have been formed.

Since the leadout conductor section connecting the coil 112 to the terminal electrodes 13*a* and 13*b*, in particular, the second leadout conductor consisting of the first connection conductors 115*a* and 115*b* and the connection conductors 116*a* and 116*b* is most likely to be broken due to the internal strain, the gap is preferably formed at least around the second leadout conductor to be impregnated with the resin.

Although the first to seventeenth embodiments have been described by referencing the laminated inductor as an example of a laminated electronic component, the present invention is not limited to this aspect. Of course, similar effects can be obtained from compote electronic components as long they have a coil in a chip of a laminated structure.

In addition, the present invention can be implemented in many other forms without deviating from its sprits and major features. Thus, the above embodiments are only illustrative in any sense and should not be construed to be limitative. The scope of the present invention is indicated by the claims and is not bound by the specification. Moreover, all variatiosn and changes belonging to the uniform scope of the claims fall within the scope of the present invention.

What is claimed is:

1. An electronic component comprising a coil having interconnected segments buried on faces of laminations in a rectangular-parallelepiped laminated chip and first and second terminal electrodes respectively located at opposite first and second ends of the chip, first and second lead out conductors respectively connected between opposite first and second ends of the coil and the first and second terminal electrodes, having a longitudinal axis extending at right angles to the faces of the laminations and on a straight line joining central points of the opposed end surfaces of the chip where said terminal electrodes are located, the chip having a size and shape enabling mounting thereof on a circuit board surface in a position such that the coil axis extends parallel to the circuit board surface, the coil having a winding locus as seen in the direction of said coil axis and projected on an end face of the chip perpendicular to the coil axis, and the winding locus and leadout conductors being positioned such that when the electronic component is mounted on a circuit board with the coil axis parallel to the circuit board surface, the winding locus and the distance between the leadout components and the circuit board remain unchanged despite a reversal in the position of the electronic component on the circuit board.

2. The electronic component according to claim 1 wherein the winding locus of said coil as seen in the direction of said coil axis is point-symmetrical around a central point through which said coil axis passes.

3. The electronic component according to claim 1 wherein the chip includes four sides and two end chip faces, the winding locus of said coil as seen in the direction of said coil axis being symmetrical around a straight line which is parallel to one of the four sides and orthogonal to said coil axis.

4. The electronic component according to claim 1 wherein said leadout conductors are located at the respective ends of the chip on said coil axis.

5. The electronic component according to claim 1 wherein two or more of said leadout conductors are symmetrically located at the respective ends of the chip around said coil axis.

6. The electronic component according to claim 1 wherein a cross section of the chip perpendicular to said coil axis is square.

7. The electronic component according to claim 1 wherein a cross section of the chip perpendicular to said coil axis is square, said winding locus of said coil as seen in the direction of said coil axis is line-symmetrical around each of any two orthogonal crossing straight lines that perpendicularly cross said coil axis.

8. The electronic component according to claim 1 wherein the winding locus of said coil as seen in the direction of said coil axis is point-symmetrical around a central point through which said coil axis passes, said leadout conductors being located at the respective ends of the chip on said coil axis.

9. The electronic component according to claim 1 wherein the winding locus of said coil as seen in the direction of said coil axis is point-symmetrical around a central point through which said coil axis passes, two or more of said leadout conductors being located at the respective ends of the chip symmetrically with said coil axis.

10. The electronic component according to claim 1 wherein the chip includes four sides and two end faces, the winding locus of said coil as seen in the direction of said coil axis being symmetrical around a straight line which is parallel to one of the four sides and orthogonal to said coil axis, said leadout conductors being located at the respective ends of the chip on said coil axis.

11. The electronic component according to claim 1 wherein the chip includes four sides and two end faces, the winding locus of said coil as seen in the direction of said coil axis being symmetrical around a straight line which is parallel to one of the four sides and orthogonal to said coil axis, two or more of said leadout conductors being located at the respective ends of the chip symmetrically around said coil axis.

12. The electronic component according to claim 1 wherein a cross section of the chip perpendicular to said coil axis is a square, the winding locus of said coil as seen in the direction of said coil axis being line-symmetrical around each of any two orthogonal straight lines crossing said coil axis perpendicularly, at least two leadout conductors joining one end of said coil and said terminal electrode together being located at the respective ends of the chip on a diagonal line of said cross section of the chip and symmetrically around said coil axis.

13. The electronic component according to claim 1 wherein a cross section of the chip perpendicular to said coil axis is a square, the winding locus of said coil as seen in the direction of said coil axis being line-symmetrical around each of any two straight lines crossing said coil axis perpendicularly, said leadout conductors being located at the respective ends of the chip at one or more sets of four different positions that are 90°-rotation-symmetrical around said coil axis.

14. An electronic component comprising a coil buried on faces of laminations in a parallelepiped-rectangular laminated chip, first and second terminal electrodes located at respective first and second opposite ends of the chip and connected to respective first and second opposite ends of the coil, leadout conductors connected between the first coil end and the first terminal electrode, a second leadout conductor connected between the second coil end and the second terminal electrode, the coil having a longitudinal axis extending at right angles to the faces of the laminations and on a straight line joining central points of the opposed end surfaces of the chip where said terminal electrodes are located, the chip having a size and shape enabling mounting thereof on a circuit board surface in a position such that the coil axis extends parallel to the circuit board surface, the first and second opposite ends of said coil being located symmetrically with respect to the coil axis, at least a portion of the leadout conductors connected between the first coil end and the first terminal electrode being located symmetrically with respect to the coil axis.

15. The electronic component according to claim 14 wherein said leadout conductor includes a first leadout conductor having one end located on said coil axis and connected to the terminal electrode and a second leadout conductor connecting the other end of the first leadout conductor and the end of the coil together.

16. The electronic component according to claim 15 wherein said second leadout conductor includes a connection conductor perpendicular to the coil axis.

17. The electronic component according to claim 15 wherein said second leadout conductor includes a first connection conductor extending parallel to said coil axis and one end connected to the coil and a second connection conductor connecting the other end of the first connection conductor and the other end of the first leadout conductor together.

18. The electronic component according to claim 17 wherein said second connection conductor is a straight line crossing said first leadout conductor at an obtuse angle.

19. The electronic component according to claim 18 wherein:

said chip includes a laminate having a laminating direction aligned with the coil axis, said second connection conductor being formed by coupling together conductors in via holes arranged and formed in steps.

20. The electronic component according to claim 17 wherein said second connection conductor is perpendicular to the coil axis.

21. The electronic component according to claim 17 wherein said second connection conductor is L-shaped and is perpendicular to the coil axis.

22. The electronic component according to claim 17 wherein said second connection conductor is I-shaped and is perpendicular to the coil axis.

23. The electronic component according to claim 17 wherein the length of said first connection conductor is larger than that of said first leadout conductor.

24. The electronic component according to claim 17 wherein the length of said first connection conductor is smaller than that of said first leadout conductor.

25. The electronic component according to claim 17 wherein the thickness of said first leadout conductor is larger than that of said first connection conductor.

26. The electronic component according to claim 15 wherein there is a gap within said coil between a member forming said chip and at least said second leadout conductor.

27. The electronic component according to claim 26 wherein said terminal electrode includes a porous metal and wherein a resin fills said gap.

28. The electronic component according to claim 20 wherein:

said terminal electrode is continuous from an end surface of said chip to a surface adjacent to the end surface, the length of said first leadout conductor being larger than that of the terminal electrode formed on a surface adjacent to said end surface.

29. The electronic component according to claim 20 wherein:

said terminal electrode is continuous from an end surface of said chip to a surface adjacent to an end surface, the length of said first leadout conductor being smaller than that of the terminal electrode formed on a surface adjacent to said end surface.

30. The electronic component according to claim 20 wherein:

said terminal electrode is continuous from an end surface of said chip to a surface adjacent to the end surface, the length of said first leadout conductor being equal to that of the terminal electrode formed on the surface adjacent to said end surface.

31. The electronic component according to claim 1 wherein:

said chip includes a laminate having a laminating direction aligned with the coil axis, said coil including a plurality of spirally connected internal conductors each comprising parallel-connected internal coil conductors arranged in two or more continuous layers and having the same shape.

32. The electronic component according to claim 1 wherein:

said chip includes a laminate having a laminating direction aligned with the coil axis, at least a portion of said leadout conductor that is parallel with the coil axis including via holes.

33. An electronic part comprising a coil having interconnected segments buried on faces of laminations in a cylindrical laminated chip and first and second terminal electrodes respectively located at opposite first and second ends of the chip and connected to the respective ends of the coil, the coil having a longitudinal axis extending at right angles to the faces of the laminations and on a straight line joining central points of the opposed end surfaces of the chip where said terminal electrodes are located, the chip having a size and shape enabling mounting thereof on a circuit board surface in a position such that the coil axis extends parallel to the circuit board surface, the coil having a winding locus as seen in the direction of said coil axis and projected on an end face of the chip perpendicular to the coil axis, and the winding locus and leadout conductors being positioned such that when the electronic part is mounted on a circuit board with the coil axis parallel to the circuit board surface, the winding locus and the distance between the leadout conductors and the circuit board remain unchanged despite a reversal in the position of the electronic part on the circuit board.

34. The electronic part according to claim 14 wherein the distance between the winding locus of the coil as seen in the direction of said coil axis and a central point through which said coil axis passes is constant in any cross section of the chip that said coil axis crosses perpendicularly, said leadout conductors joining the end of said coil and said terminal electrode being located at the respective ends of the chip on the coil axis.

35. The electronic component according to claim 14 wherein:

said chip includes a laminate having a laminating direction aligned with the coil axis, said coil including a plurality of spirally connected internal conductors each including parallel-connected internal coil conductors arranged in two or more continuous layers and having the same shape.

36. The electronic component according to claim 14 wherein:

said chip includes a laminate having a laminating direction aligned with the coil axis, at least a portion of said leadout conductor that is parallel with the coil axis including via holes.

37. An electronic component comprising a coil having interconnected segments buried on faces of laminations in a laminated chip, a terminal electrode formed on a surface of the chip and connected to an end of the coil, the coil having a longitudinal coil axis extending at right angles to the faces of the laminations, the chip having a size and shape enabling mounting thereof on a circuit board in a position such that the coil axis extends parallel to a surface of the circuit board, the chip and coil including a conductor arrangement having a position in the chip so that when the chip is mounted on a circuit board, with the coil axis parallel to the circuit board surface, the relative position between the circuit board surface and the conductor arrangement is the same regardless of whether a top surface of the chip component or a bottom surface of the chip component abuts the circuit board surface.

38. The electronic component of claim 37, wherein the coil longitudinal axis extends parallel to top and bottom surfaces of the chip, the coil having first and second ends respectively displaced from the axis by the same distance in opposite directions and being displaced from each other along the axis, a first lead extending parallel to the axis connected to the first end, a second lead extending parallel to the axis connected to the second end, the first and second leads having the same length and being embedded in the chip, a third lead connected to the first lead and extending radially between the first lead and the axis, a fourth lead connected to the second lead and extending radially between the second lead and the axis, a fifth lead connected between the third lead and a first terminal electrode, the fifth lead extending along the axis between the third lead and a first end face of the chip at right angles to the top and bottom surfaces, a sixth lead connected between the fourth lead and a second terminal electrode, the sixth lead extending between the fourth lead and a second end face of the chip at right angles to the top and bottom surfaces, the fifth and sixth leads having the same axial length, the first terminal electrode being on the first end face and including a portion extending along side walls of the chip, including the top and bottom surfaces of the chip, as well as side walls of the chip at right angles to the top and bottom surfaces, the second terminal electrode being on the second end face and including a portion extending along side walls of the chip, including the top and bottom surfaces and surfaces of the chip, as well as side walls of the chip at right angles to the top and bottom surfaces, the first and second terminal electrodes respectively extending along the surfaces of the chip in the axial direction from the first and second end faces through a distance equal to the lengths of the fifth and sixth leads in the axial direction.

39. The electronic component of claim 37, wherein the chip is shaped as a cylinder having a circular cross section in plates at right angles to the axis.

40. The electronic component of claim 39, wherein the coil includes a plurality of laminated sheets, each carrying a conductor having an arcuate shape defined by a segment of a circle, each of the circle segments spanning substantially the same arcuate length.

41. The electronic component of claim 40, wherein each of the conductors has a semi-circular shape.

42. The electronic component of claim 37, wherein the coil includes conductors with a rectangular locus as projected onto a plane at right angles to the coil axis.

43. The electronic component of claim 42, wherein the coil includes a plurality of laminated sheets, each carrying a conductor including at least two sides connected to each other.

44. The electronic component of claim 43, wherein the conductors on the lamination faces at opposite ends of the coil have leads connected to them, the leads extending in a direction parallel to the coil axis, first and second terminal electrodes respectively on first and second end faces of the component intersecting the coil axis, the leads being connected between the conductors at the ends of the coil and the terminal electrodes, the average position of the leads extending between the conductors at each of the terminal electrodes relative to the coil axis being on the coil axis.

45. The electronic component of claim 44, wherein one of the leads extending and connected between each end conductor and each terminal electrode is on the axis.

46. The electronic component of claim 44, wherein a plurality of said leads extend and are connected between each of said conductors at the ends of the coil and each of the terminal electrodes, the plurality of leads being symmetrically located relative to the coil axis.

47. The electronic component of claim 1 wherein at least a portion of two or more of said leadout conductors are located at the respective ends of the chip symmetrically around said coil axis.

48. An electronic component comprising a coil buried on faces of laminations in a laminated chip and first and second terminal electrodes located at respective first and second opposite ends of the chip and connected to respective first and second opposite ends of the coil, leadout conductors connected between the first coil end and the first terminal electrode;

a second leadout conductor connected between the second coil end and the second terminal electrode, the coil having a longitudinal axis extending at right angles to the faces of the laminations and on a straight line joining central points of the opposed end surfaces of the chip where said terminal electrodes are located, the first and second opposite ends of said coil being located symmetrically with respect to the coil axis, at least a portion of the leadout conductors connected to the respective ends of said coil being located symmetrically around the coil axis.

49. The electronic component of claim 37 wherein said conductor arrangement includes first and second leadout conductors, said first leadout conductor including a via hole, one end of the first leadout conductor being connected to the terminal electrode, the second leadout conductor being connected to the other end of the first leadout conductor and the end of the coil.

50. The electronic component of claim 49 wherein said leadout conductor has a portion which deviates from a winding locus of the coil as projected into a plane perpendicular to the coil axis.

* * * * *